US006502568B2

(12) United States Patent
Kunimoto

(10) Patent No.: US 6,502,568 B2
(45) Date of Patent: Jan. 7, 2003

(54) MODEL GUN IN THE TYPE OF REVOLVER

(75) Inventor: Keiichi Kunimoto, Tokyo (JP)

(73) Assignee: Western Arms, Tokyo (JP)

( * ) Notice: Subject to any disclaimer, the term of this patent is extended or adjusted under 35 U.S.C. 154(b) by 0 days.

(21) Appl. No.: 09/817,127

(22) Filed: Mar. 27, 2001

(65) Prior Publication Data

US 2001/0027786 A1 Oct. 11, 2001

(30) Foreign Application Priority Data

Mar. 30, 2000 (JP) ..... 2000-093544
Mar. 31, 2000 (JP) ..... 2000-096410

(51) Int. Cl.[7] ..... F41B 11/32
(52) U.S. Cl. ..... 124/73; 124/76; 124/48
(58) Field of Search ..... 124/73, 70, 74, 124/76, 48; 42/58

(56) References Cited

U.S. PATENT DOCUMENTS

| | | | | | |
|---|---|---|---|---|---|
| 1,088,689 | A | * | 3/1914 | Eck | 124/48 |
| 2,980,096 | A | * | 4/1961 | Merz | 124/36 |
| 3,212,489 | A | * | 10/1965 | Merz | 124/36 |
| 3,236,222 | A | * | 2/1966 | Pitcher | 124/36 |
| 5,622,160 | A | * | 4/1997 | Casas Salva | 124/59 |

FOREIGN PATENT DOCUMENTS

JP 07-29435 7/1995

OTHER PUBLICATIONS

Pp. 52 to 56, Mar. 2000 of monthly magazine: Gekkan Arms Magazine, published on Mar. 1, 2000 by Kabushikigaisya Hobby Japan.

* cited by examiner

*Primary Examiner*—Charles T. Jordan
*Assistant Examiner*—John W. Zerr
(74) *Attorney, Agent, or Firm*—Nixon Peabody LLP; Donald R. Studebaker

(57) ABSTRACT

A model gun in the type of revolver includes a frame member to which a barrel is fixed and a hammer is rotatably attached, a cylindrical movable member containing a pressure accumulating chamber, a plurality of bullet holding chambers, a plurality of gas leading passages connected with the bullet holding chambers respectively, and a plurality of valves each operative to cause one of the gas leading passages to open into the pressure accumulating chamber in response to movement of the hammer and mounted detachably on the frame member between the barrel and the hammer, a control mechanism operative to keep selectively the cylindrical movable member mounted detachably on the frame member in a locked condition wherein one of the bullet holding chambers is positioned to face closely a rear end portion of the barrel and to release the cylindrical movable member mounted detachably on the frame member from the locked condition so as to be revolved on a central axis thereof in response to positions of a trigger, a driving mechanism operative to cause the cylindrical movable member mounted detachably on the frame member and released from the locked condition to revolve on the central axis thereof in accordance with movement of the trigger, and a supporting member attached rotatably to the frame member for supporting the cylindrical movable member so as to be mounted detachably on the frame member and detached from the frame member to take a swung out position selectively.

9 Claims, 24 Drawing Sheets

MODEL GUN IN THE TYPE OF REVOLVER

BACKGROUND OF THE INVENTION

1. Field of the Invention

The present invention generally relates to a model gun in the type of revolver, and more particularly, is directed to improvements in a model gun of the revolver type, which has a cylindrical member containing a plurality of bullet holding chambers which are arranged around a central axis of the cylindrical member at predetermined angular intervals and each of which holds a sham bullet therein, and provided on a frame member between a barrel fixed to the frame member and a hammer attached rotatably to the frame member. The bullet holding chambers are revolved around the central axis of the cylindrical member in accordance with movements of a trigger so that one of the bullet holding chambers is positioned to face closely a rear end portion of the barrel and the sham bullet in the bullet holding chamber facing the rear end portion of the barrel structure is able to be shot through the barrel with gas pressure.

2. Description of the Prior Art

A model gun by which a sham bullet made of plastics or the like is shot with gas pressure is made to imitate a real gun in not only its color and shape but also its apparent operations. As one of these model guns, there has been proposed such a type as to be made to imitate a real gun of the revolver type, namely, a model gun in the type of revolver. In the model gun of the revolver type, a cylindrical movable member which is provided between a barrel and a hammer and in which a plurality of bullet holding chambers each holding a sham bullet therein are arranged around a central axis of the cylindrical movable member at predetermined angular intervals is revolved on the central axis thereof in accordance with movements of a trigger so that one of the bullet holding chambers is positioned to face closely a rear end portion of the barrel structure. The sham bullets put respectively in the bullet holding chambers which are provided in the cylindrical movable member are successively shot one by one with gas pressure which acts on the sham bullet in the bullet holding chamber in synchronism with the revolution of the cylindrical movable member on the central axis thereof.

As for the model gun of the revolver type in which gas pressure is utilized for shooting, it has been proposed to make such an arrangement that a cylindrical movable member which is provided with a plurality of pits arranged at predetermined intervals, into each of which a cartridge containing sham bullets is inserted, so as to form a magazine, is positioned between a barrel structure and a hammer, as shown in, for example, Japanese utility model publication No.07-29435. According to the arrangement thus proposed, a plurality of bullet holding chambers in each of which the sham bullet is put are formed substantially with the cartridges inserted into the pits, respectively, in the cylindrical movable member. The sham bullet put in the bullet holding chamber is shot with air pressure (gas pressure) supplied to the bullet holding chamber through a relatively slender and long tube from an air pump (a pressure accumulating chamber) provided in a grip.

It has been also proposed to make another arrangement that a cylindrical member in which a pressure accumulating chamber which is charged with liquefied gas, a gas leading passage extending from the pressure accumulating chamber, a gas releasing valve, and a plurality of bullet holding chambers in each of which a sham bullet is put and which are arranged at predetermined intervals, are provided, is positioned between a barrel and a hammer, as shown on pages 52 to 56, March 2000 of the monthly magazine: [GEKKAN ARMS MAGAZINE], published on Mar. 1, 2000 by KABUSHIKIGAISYA HOBBY JAPAN in Japan. According to this another arrangement thus proposed, each of the sham bullets put respectively in the bullet holding chambers provided in the cylindrical member is shot with gas pressure released through the gas releasing valve and the gas leading passage from the pressure accumulating chamber provided in the cylindrical member.

In the model gun of the revolver type in which the sham bullet put in the bullet holding chamber provided in the cylindrical movable member is shot with the gas pressure supplied to the bullet holding chamber from the pressure accumulating chamber provided in the grip as mentioned above, the revolution of the cylindrical movable member on the central axis thereof for causing one of the bullet holding chambers to move into the highest position substantially on a central axis of the barrel structure is carried out in synchronism with the rotary movement of the hammer to a cocked position from an initial position. A nozzle at the end of the relatively slender and long tube extending from the pressure accumulating chamber provided in the grip is moved to come into contact with a rear opening of the bullet holding chamber placed at the highest position when the trigger is pulled. Then, a piston in the pressure accumulating chamber provided in the grip operates to release the gas pressure through the tube from the pressure accumulating chamber and then cause the gas pressure to blow off through the nozzle at the end of the relatively slender and long tube in synchronism with the rotary movement of the hammer to the initial position from the cocked position.

Accordingly, when the trigger is pulled and thereby the hammer is rotated to return to the initial position from the cocked position after the hammer has been moved into the cocking position from the initial position, the gas pressure blowing off through the nozzle at the end of the relatively slender and long tube acts on the sham bullet put in the bullet holding chamber placed at the highest position to face closely the rear end portion of the barrel structure so that the sham bullet is shot with the gas pressure through the barrel structure from the bullet holding chamber placed at the highest position.

In the model gun of the revolver type in which the sham bullet put in the bullet holding chamber provided in the cylindrical member is shot with the gas pressure supplied to the bullet holding chamber from the pressure accumulating chamber provided in the cylindrical member as mentioned also above, the cylindrical member is provided at a fixed position on a frame member. The cylindrical member has a dual structure comprising a fixed portion which is fixed on the frame member and a revolving portion which surrounds the fixed portion in such a manner as to be able to revolve around the central axis of the cylindrical member. The fixed member is provided therein with the pressure accumulating chamber, the gas leading passage extending from the pressure accumulating chamber and the gas releasing valve operative to open and close selectively the gas leading passage. The revolving portion is provided therein with the bullet holding chambers arranged around the central axis of the cylindrical member at predetermined angular intervals.

When the hammer is manually rotated to move into a predetermined position from an initial position, the revolving portion of the cylindrical member is revolved on the central axis of the cylindrical member with rotary movement of a trigger caused by the rotary movement of the hammer so that one of the bullet holding chambers is connected with the gas leading passage provided in the fixed portion and is positioned to face closely a rear end portion of the barrel. Then, when the hammer which has been moved into the predetermined position by manual operation is rotated to return to the initial position from the predetermined position, the gas releasing valve provided in the fixed portion of the cylindrical member is moved to control the gas leading passage to be open from closed in accordance with the movement of the trigger. As a result, the gas pressure is supplied to the bullet holding chamber facing closely the rear end portion of the barrel through the gas leading passage from the pressure accumulating chamber provided in the fixed portion of the cylindrical member so that the sham bullet put in the bullet holding chamber facing closely the rear end portion of the barrel is shot through the barrel with the gas pressure.

In the previously proposed model gun of the revolver type which has the pressure accumulating chamber provided in the grip, the cylindrical movable member is provided therein only with the plural bullet holding chambers and therefore can be revolved on the central axis thereof in its entirety. This means that the cylindrical movable member can be supported by a swinging support member mounted rotatably on the frame member to be mounted on the frame member between the barrel and the hammer and detached from the frame member to take a swung out position selectively. Accordingly, with the cylindrical movable member detached from the frame member to take the swung out position, the bullet holding chambers provided in the cylindrical movable member are easily loaded with the sham bullets.

However, since the bullet holding chamber which is positioned to face closely the rear end portion of the barrel is supplied with the gas pressure through the relatively slender and long tube from the pressure accumulating chamber, the gas pressure acting on the sham bullet put in the bullet holding chamber facing closely the rear end portion of the barrel is so reduced that it is likely hard to shoot the sham bullet with enough power and initial velocity. This problem causes a user who want to enjoy the model gun to feel dissatisfied.

In the meanwhile, with the previously proposed model gun of the revolver type which has the pressure accumulating chamber provided in the cylindrical member, the gas leading passage which is provided, together with the pressure accumulating chamber and the gas releasing valve, in the fixed portion of the cylindrical member for leading the gas pressure from the pressure accumulating chamber to the bullet holding chamber which is positioned to face closely the rear end portion of the barrel, is relatively short and therefore it is possible to cause the gas pressure to act on the sham bullet put in the bullet holding chamber facing closely the rear end portion of the barrel without reduction in pressure.

However, as for the previously proposed model gun of the revolver type which has the pressure accumulating chamber provided in the cylindrical member, there are the following disadvantages resulting from the fact that the cylindrical member has the dual structure comprising the fixed portion, which is fixed on the frame member and provided therein with the pressure accumulating chamber, the gas leading passage extending from the pressure accumulating chamber and the gas releasing valve operative to open and close selectively the gas leading passage, and the revolving portion, which surrounds the fixed portion in such a manner as to be able to revolve around the central axis of the cylindrical member and is provided therein with the bullet holding chambers arranged around the central axis of the cylindrical member at predetermined angular intervals.

That is, when the sham bullet is shot through the barrel from the bullet holding chamber, the revolving portion of the cylindrical member is so revolved as to move one of the bullet holding chambers which contains the sham bullet into a position facing closely a front end portion of the gas leading passage provided in the fixed portion of the cylindrical member and then the gas pressure is supplied to the bullet holding chamber facing closely the front end portion of the gas leading passage through the gas releasing valve and the gas leading passage from the pressure accumulating chamber. Under such a situation, with the gas leading passage and the bullet holding chamber containing the sham bullet, which are separated from each other so as to be able to have mutual movements, the gas pressure is supplied to the bullet holding chamber from the gas leading passage.

Accordingly, it is necessary to prevent a gas leak between the front end portion of the gas leading passage and the bullet holding chamber facing closely the front end portion of the gas leading passage. It is not easy at all to prevent effectively such a gas leak and an appropriate sealing structure is required to be provided between the front end portion of the gas leading passage and the bullet holding chamber facing closely the front end portion of the gas leading passage. This means that the cylindrical member is required to have the appropriate sealing structure provided between the front end portion of the gas leading passage and the bullet holding chamber facing closely the front end portion of the gas leading passage in addition to the dual structure comprising the fixed portion and the revolving portion and therefore the construction of the cylindrical member is extremely complicated.

Further, since the fixed portion of the cylindrical member is fixed on the frame member, the cylindrical member can not be revolved on the central axis thereof in its entirety and in addition can not be detached from the frame member to take a swung out position. Consequently, it is impossible to load easily the bullet holding chambers provided in the cylindrical member with the sham bullets with the cylindrical member detached from the frame member to take the swung out position. Such a model gun is inferior in imitativeness to the real gun of the revolver type.

Besides, as for the model gun utilizing the gas pressure for shooting the sham bullet as described above, the gas releasing valve for controlling the gas leading passage is usually operated with blow by the hammer and it is prohibited to set a portion suffering the blow by hammer on the central axis of the barrel.

Accordingly, it has been desired such a model gun of the revolver type that a cylindrical member which contains a plurality of bullet holding chambers and is operative to revolve on its central axis in its entirety for positioning one of the bullet holding chambers so as to face closely a rear end portion of a barrel, further operative to cause gas pressure from a pressure accumulating chamber to act on a sham bullet put in the bullet holding chamber facing closely the rear end portion of the barrel with enough pressure value without a specific sealing structure between each of the bullet holding chambers and gas leading passage for leading the gas pressure from the pressure accumulating chamber, and is able to be mounted detachably on a frame member and detached from the frame member to take a swung out position selectively. In addition, the model gun of the revolver type thus desired is also required as occasion demands to have a portion suffering blow by a hammer and positioned out of a central axis of a barrel. However, there has not been previously proposed any model gun of the revolver type which meets the conditions mentioned above.

OBJECTS AND SUMMARY OF THE INVENTION

It is an object of the present invention to provide a model gun in the type of revolver, in which a cylindrical member containing a plurality of bullet holding chambers which are arranged around a central axis of the cylindrical member at predetermined angular intervals and each of which holds a sham bullet therein, is provided on a frame member between a barrel fixed to the frame member and a hammer attached rotatably to the frame member in such a manner that the bullet holding chambers are revolved around the central axis of the cylindrical member in accordance with movements of a trigger so that one of the bullet holding chambers is positioned to face closely a rear end portion of the barrel and the sham bullet in the bullet holding chamber facing the rear end portion of the barrel is able to be shot through the barrel with gas pressure, and which avoids the aforementioned disadvantages encountered with the prior art.

Another object of the present invention is to provide a model gun in the type of revolver, in which a cylindrical member containing a plurality of bullet holding chambers which are arranged around a central axis of the cylindrical member at predetermined angular intervals and each of which holds a sham bullet therein, is provided on a frame member between a barrel fixed to the frame member and a hammer attached rotatably to the frame member in such a manner that the bullet holding chambers are revolved around the central axis of the cylindrical member in accordance with movements of a trigger so that one of the bullet holding chambers is positioned to face closely a rear end portion of the barrel and the sham bullet in the bullet holding chamber facing the rear end portion of the barrel is able to be shot through the barrel with gas pressure, and in which the cylindrical member is operative to revolve on the central axis thereof in its entirety for positioning one of the bullet holding chambers so as to face closely the rear end portion of the barrel, further operative to cause gas pressure from a pressure accumulating chamber to act on the sham bullet put in the bullet holding chamber facing closely the rear end portion of the barrel with enough pressure value without a specific sealing structure between each of the bullet holding chambers and a gas leading passage for leading the gas pressure from the pressure accumulating chamber, and is able to be mounted detachably on the frame member and detached from the frame member to take a swung out position selectively.

A further object of the present invention is to provide a model gun in the type of revolver, in which a cylindrical member containing a plurality of bullet holding chambers which are arranged around a central axis of the cylindrical member at predetermined angular intervals and each of which holds a sham bullet therein, is provided on a frame member between a barrel fixed to the frame member and a hammer attached rotatably to the frame member in such a manner that the bullet holding chambers are revolved around the central axis of the cylindrical member in accordance with movements of a trigger so that one of the bullet holding chambers is positioned to face closely a rear end portion of the barrel and the sham bullet in the bullet holding chamber facing the rear end portion of the barrel is able to be shot through the barrel with gas pressure, and in which the cylindrical member is operative to revolve on the central axis thereof in its entirety for positioning one of the bullet holding chambers so as to face closely the rear end portion of the barrel, further operative to cause gas pressure from a pressure accumulating chamber to act on the sham bullet put in the bullet holding chamber facing closely the rear end portion of the barrel with enough pressure value without a specific sealing structure between each of the bullet holding chambers and a gas leading passage for leading the gas pressure from the pressure accumulating chamber, and is able to be mounted detachably on the frame member and detached from the frame member to take a swung out position selectively, and a portion suffering blow by the hammer is positioned out of a central axis of the barrel.

According to the present invention, there is provided a model gun in the type of revolver, which comprises a frame member to which a barrel is fixed and a hammer is rotatably attached, a cylindrical movable member containing a pressure accumulating chamber for accumulating gas pressure, a plurality of bullet holding chambers arranged around a central axis to the cylindrical movable member at predetermined angular intervals for holding sham bullets respectively, a plurality of gas leading passages connected with the bullet holding chambers respectively, and a plurality of valves each operative to cause one of the gas leading passages to open into the pressure accumulating chamber in response to movement of the hammer, and selectively mounted detachably on the frame member between the barrel and the hammer, a control mechanism operative to keep the cylindrical movable member mounted detachably on the frame member in a locked condition wherein one of the bullet holding chambers is positioned to face closely a rear end portion of the barrel and to release the cylindrical movable member mounted detachably on the frame member from the locked condition so as to be revolved on a central axis thereof selectively in response to positions of a trigger, a driving mechanism operative to cause the cylindrical movable member mounted detachably on the frame member and released from the locked condition to revolve on the central axis thereof in accordance with movement of the trigger and a supporting member attached rotatably to the frame member for supporting the cylindrical movable member so as to be mounted detachably on the frame member and detached from the frame member to take a swung out position selectively.

In one embodiment of model gun according to the present invention, when the trigger is pulled in the situation wherein the cylindrical movable member supported by the supporting member is mounted detachably on the frame member, the cylindrical movable member commences to be revolved on the central axis thereof by the driving mechanism and the hammer commences to rotate from its initial position.

Then, after the cylindrical movable member ceases to revolve, the hammer rotates to strike a blow at a portion for suffering the blow by the hammer and return to the initial position. With this blow by the hammer, one of the valves in the cylindrical movable member, which corresponds to the gas leading passage connected with the bullet holding chamber facing closely the rear end portion of the barrel, operates to cause the corresponding gas leading passage to open into the pressure accumulating chamber. The portion for suffering the blow by the hammer is positioned out of a central axis of the bullet holding chamber facing closely the rear end portion of the barrel.

Further, the pressure accumulating chamber, the bullet holding chambers and the gas leading passages are formed to be fixed in the cylindrical movable member and the valves are constituted with a plurality of opening and closing valves provided to correspond to the gas leading passages, respectively.

In another embodiment of model gun according to the present invention, the pressure accumulating chamber is formed to be fixed in the cylindrical movable member and the valves are constituted with a plurality of movable valves each containing the bullet holding chamber and the gas leading passage connected with the bullet holding chamber and provided to be movable in the cylindrical movable member. The movable valve containing the bullet holding chamber and the gas leading passage connected with the bullet holding chamber is operative to take selectively a gas shutting off position for removing the gas leading passage from the pressure accumulating-chamber and a gas introducing position for causing the gas leading passage to open into the pressure accumulating chamber.

In the model gun thus constituted in accordance with the present invention, under a condition wherein the cylindrical movable member supported by the supporting member attached rotatably to the frame member is mounted detachably on the frame member, a manual operation to the trigger is started. The cylindrical movable member kept in the locked condition is released from the locked condition by the control mechanism to be revolved on the central axis thereof by the driving mechanism in response to the manual operation to the trigger. After that, the cylindrical movable member is caused to stop revolving and put again in the locked condition by the control mechanism so that one of the bullet holding chambers provided in the cylindrical movable member is positioned to face closely the rear end portion of the barrel. Then, the gas leading passage connected with the bullet holding chamber facing closely the rear end portion of the barrel is caused by the corresponding valve to open into the pressure accumulating chamber, so that gas pressure is supplied to the bullet holding chamber facing closely the rear end portion of the barrel through the gas leading passage from the pressure accumulating chamber to act on the sham bullet put in that bullet holding chamber and therefore the bullet is shot through the barrel with the gas pressure.

As described above, the cylindrical movable member which is supported by the supporting member attached rotatably to the frame member so as to be mounted detachably on the frame member and detached from the frame member to take the swung out position selectively is structured to contain the pressure accumulating chamber, the bullet holding chambers, the gas leading passages connected with the bullet holding chambers respectively and the valves corresponding to the gas leading passages respectively without a dual structure comprising fixed and revolving portions, and is able to be revolved in its entirety on the central axis thereof. Further, the gas pressure is supplied to the bullet holding chamber facing closely the rear end portion of the barrel through the gas leading passage which is formed to be relatively short from the pressure accumulating chamber with a relatively simplified structure without a specific sealing structure between each of the bullet holding chambers and gas leading passage in the cylindrical movable member. Accordingly, the gas pressure supplied to the bullet holding chamber facing closely the rear end portion of the barrel acts on the sham bullet put in the bullet holding chamber with enough pressure value.

In addition, the cylindrical movable member is able to be moved smoothly from a mounted position on the frame member to the swung out position or from the swung out position to the mounted position on the frame member by the supporting member rotating to the frame member. Consequently, it is possible to load easily the bullet holding chambers provided in the cylindrical movable member with the sham bullets with the cylindrical member surely detached from the frame member to take the swung out position.

In one embodiment of model gun constituted in accordance with the present invention, the revolution of the cylindrical movable member on the central axis thereof caused by the driving mechanism and the rotation of the hammer from the initial position are carried out in response to the manual operation to the trigger and then the cylindrical movable member is caused to stop revolving just before the hammer strikes the blow at the portion for suffering the blow by the hammer and turns its rotating direction to return to the initial position. When the hammer strikes the blow at the portion for suffering the blow by the hammer and returns to the initial position, the valve which corresponds to the gas leading passage connected with the bullet holding chamber facing closely the rear end portion of the barrel operates to cause the corresponding gas leading passage to open into the pressure accumulating chamber in response to the blow by the hammer.

In this case, since the revolution of the cylindrical movable member on the central axis thereof for positioning one of the bullet holding chambers to face closely the rear end portion of the barrel, the rotation of the hammer from the initial position and another rotation of the hammer to return to the initial position are carried out by means of the manual operation to the trigger, the sham bullets put in the bullet holding chambers respectively in the cylindrical movable member are successively shot one by one with the gas pressure supplied from the pressure accumulating chamber when the trigger is manually operated repeatedly.

The portion for suffering the blow by the hammer is positioned out of the central axis of the bullet holding chamber facing closely the rear end portion of the barrel and the central axis of the bullet holding chamber facing closely the rear end portion of the barrel is substantially coincident with a central axis of the barrel. Accordingly, the portion for suffering the blow by the hammer is substantially positioned out of the central axis of the barrel.

Each of the opening and closing valves corresponding respectively to the gas leading passages which are fixed, together with the pressure accumulating chamber and the bullet holding chambers, to the cylindrical movable member is provided in the cylindrical movable member to move with the blow by the hammer at the portion for suffering the blow by the hammer.

In another embodiment of model gun constituted in accordance with the present invention, each of the movable valves, which is formed to contain the bullet holding chamber and the gas leading passage connected with the bullet holding chamber, is provided to be movable in the cylindrical movable member to which the pressure accumulating chamber is fixed so as to remove the gas leading passage from the pressure accumulating chamber and to cause the gas leading passage to open into the pressure accumulating chamber selectively.

The above, and other objects, features and advantages of the present invention will become apparent from the following detailed description taken in conjunction with the accompanying drawings.

DESCRIPTION OF THE PREFERRED EMBODIMENTS

Figure 1:
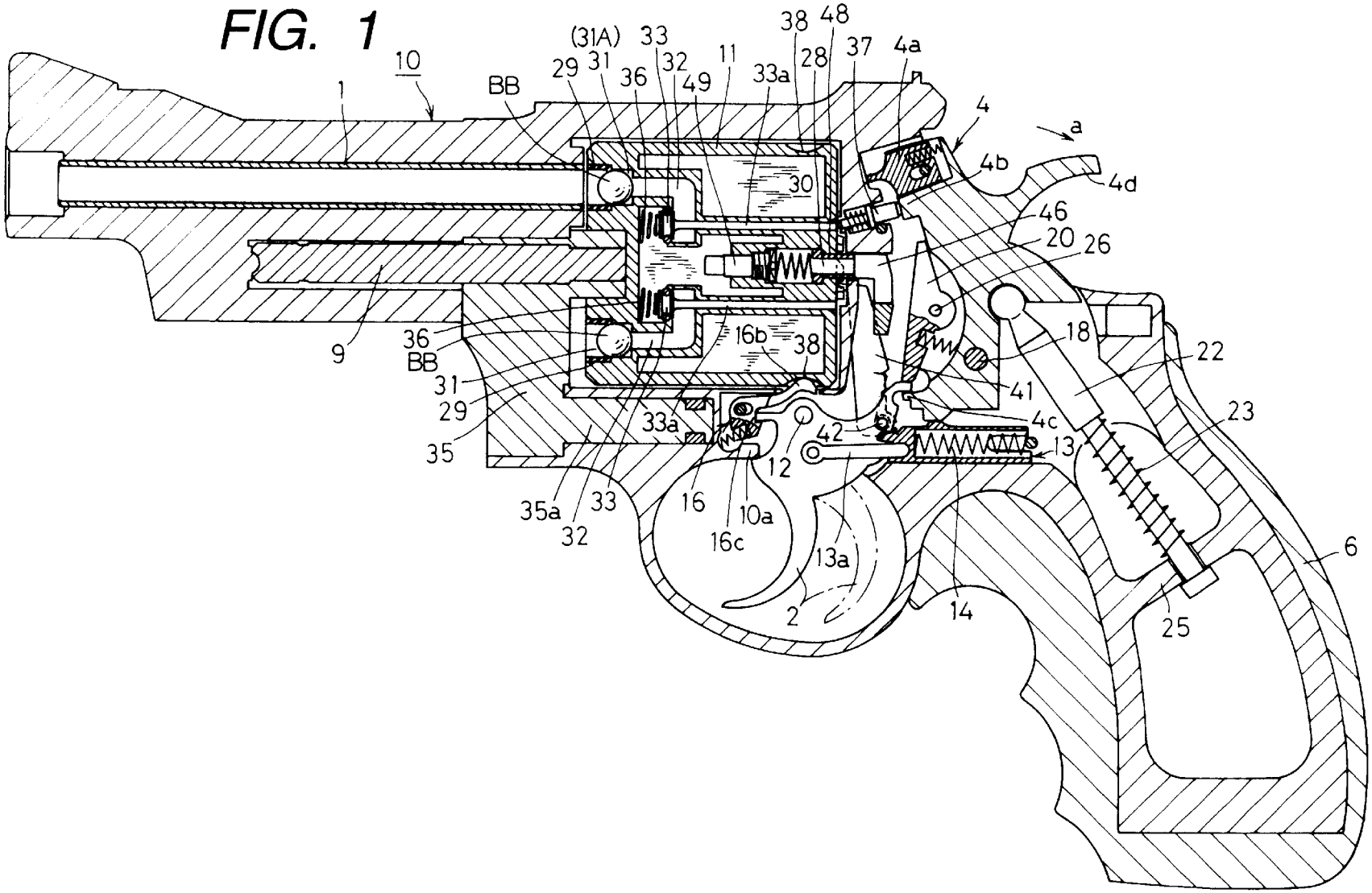
FIG. 1 is a schematic cross-sectional view showing one embodiment of model gun in the type of revolver according to the present invention.
Figure 2:
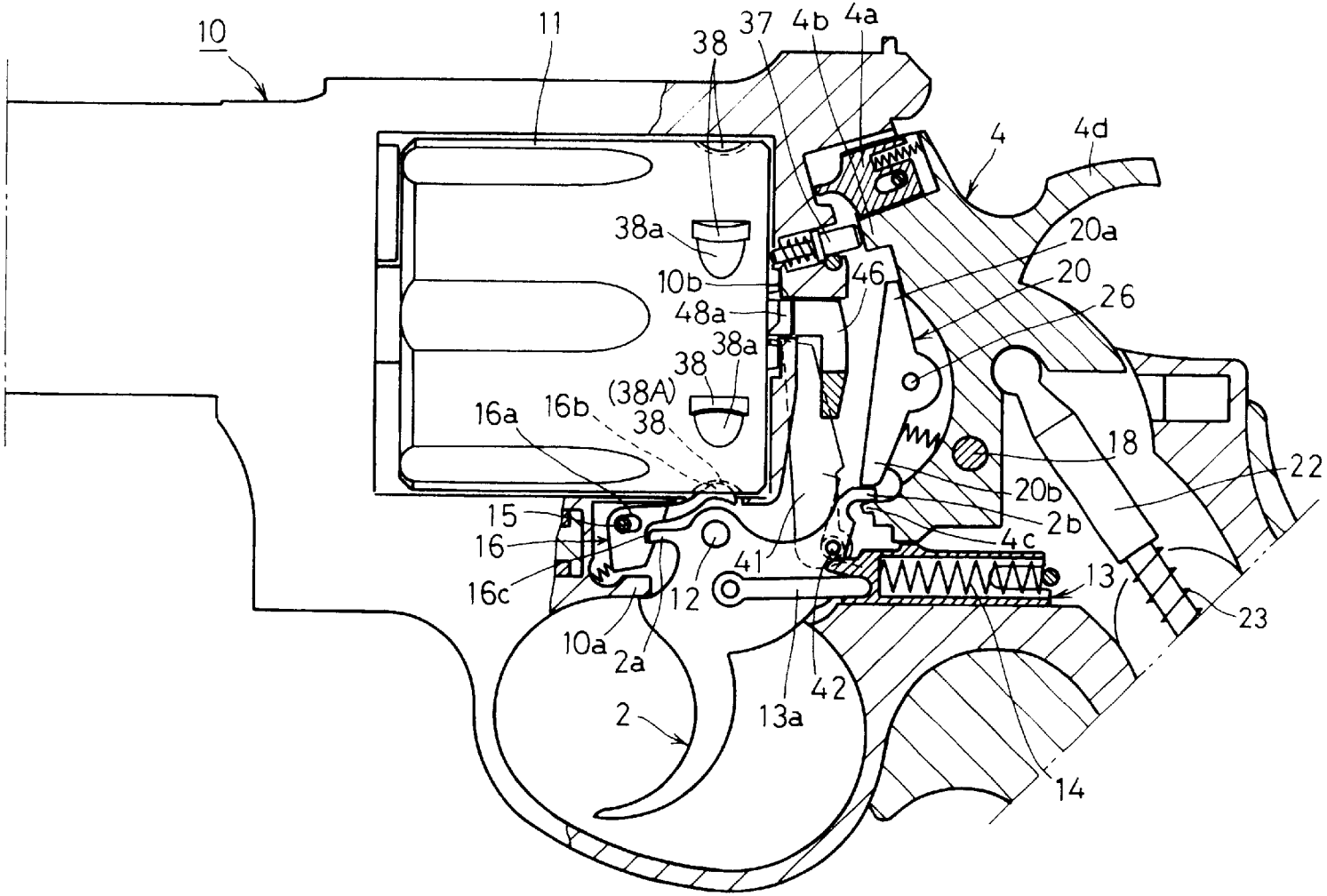
FIG. 2 is a schematic partial cross sectional view showing an essential portion of the embodiment shown in FIG. 1.

FIGS. 1 and 2 show a first embodiment of model gun in the type of revolver according to the present invention.

Referring to FIGS. 1 and 2, the first embodiment has a frame member 10 to which a barrel 1 is fixed, a trigger 2 and a hammer 4 are attached and a grip 6 is provided. In the condition shown in FIGS. 1 and 2, a cylindrical movable member 11 which is loaded with a plurality of sham bullets to be shot with gas pressure is detachably mounted with its central axis extending substantially in parallel with a central axis of the barrel 1 on the frame member 10 between the barrel 1 and the hammer 4.

The cylindrical movable member 11 is able to be rotated on its central axis and detached from the frame member to take a swung out position as explained later on.

The trigger 2 has an upper part to which a front projection 2*a* projecting forwardly and a rear projection 2*b* projecting backwardly and is attached with a pivot 12 to the frame member 10. An end portion of a rod 13*a* which extends from a sliding member 13 provided to be movable to the frame member 10 is attached to a mid portion of the trigger 2. A spring 14 with its end attached to the frame member 10 is contained in the sliding member 13.

The trigger 2 is rotatable on the pivot 12 between an initial position shown with a solid line in FIG. 1 and a shooting position shown with a dot-dash line in FIG. 1 and forced elastically to cause the mid-portion thereof to come into contact with a projection 10*a* provided on the frame member 10 by the spring 14. The sliding member 13 moves backward in accordance with the rotation of the trigger 2 in a direction against the elastic force of the spring 14 and moves forward in accordance with the rotation of the trigger 2 in a direction following the elastic force of the spring 14.

A positioning member 16 which is rotatably attached with an axis 15 to the frame member 10 is provided for positioning the cylindrical movable member 11 to the barrel 1 in the vicinity of the trigger 2. An opening 16*a* through which the axis 15 extends is provided on the positioning member 16 and therefore the positioning member 16 is movable within the limits of the opening 16*a* to rotate on the axis 15, as shown in FIG. 2.

The hammer 4 has an upper part provided with a movable portion 4*a* and striking portion 4*b*, a lower part provided with an axis 18 and projection 4*c* projecting backwardly to come into contact selectively with the rear projection 2*b* of the trigger 2 and a mid part to which a rotatable member 20 is attached and is rotatably attached with the axis 18 to the frame member 10. The mid part of the hammer 4 is provided with an actuating portion 4*d*. The movable member 4*a* provided on the upper part of the hammer 4 is forced to tend to go away from the actuating portion 4*d* by the elastic force of a spring acting on the movable member 4*a*.

An upper end portion of a hammer strut 22 extending from the inside of the grip 6 is connected with the hammer 4. A lower end portion of the hammer strut 22 engages with a stopper 25 provided in the grip 6 so that the hammer strut 22 is operative to go up in accordance with the elastic force of the coil spring 23 through which the hammer strut 22 extends and to go down against the elastic force of the coil spring 23. This hammer strut 22 is caused to go down to compress the coil spring 23 when the hammer 4 rotates in the direction indicated by an arrow "a" in FIG. 1 ("a" direction) to cause the upper part thereof to go away from the cylindrical movable member 11.

The rotatable member 20 which has an upper contacting portion 20*a* for coming into contact with the upper part of the hammer 4 in response to the position of the trigger 2 and a lower contacting portion 20*b* extending toward the lower part of the hammer 4 for coming into contact with the rear projection 2*b* of the trigger 2 in response to the position of the trigger 2 is rotatably attached with a pivot 26 to the hammer 4. The rotatable member 20 thus formed is forced to cause the upper contacting portion 20*a* to come into contact with the upper part of the hammer 4 by a spring acting on the lower contacting portion 20*b*.

The cylindrical movable member 11 contains a pressure accumlating chamber 30 which is charged through a gas injecting port 28 with, for example, liquefied gas, a plurality of bullet holding chambers 31 arranged around the central axis of the cylindrical movable member 11 at predetermined angular intervals, a plurality of gas leading passages 32 each extending from the pressure accumulating chamber 30 to be connected with the bullet holding chambers 31, respectively, which are incorporated and fixed in the cylindrical movable member 11, as shown in FIG. 1. Each of the gas leading passages 32 which connects each of the pressure accumulating chamber 30 with the bullet holding chamber 31 is relatively short in its length between the pressure accumulating chamber 30 and the bullet holding chamber 31. Further, a plurality of opening and closing valves 33 are movably provided to correspond to the gas leading passages 32 respectively in the cylindrical movable member 11. Each of the opening and closing valves 33 is operative to control the gas leading passage 32 corresponding thereto to be open and closed selectively.

In case of the first embodiment shown in FIGS. 1 and 2, six bullet holding chamber 31, six gas leading passages 32 and six opening and closing valves 33 are provided in the cylindrical movable member 11 (Two of the six bullet holding chamber 31, two of the six gas leading passages 32 and two of the six opening and closing valves 33 appear in FIG. 1.)

A rod 9 extends forwardly from a central portion of the cylindrical movable member 11 in which the pressure accumulating chamber 30, the bullet holding chambers 31 and the gas leading passages 32 are incorporated to be fixed and the opening and closing valves 33 corresponding to the gas leading passages 32 respectively are provided. The rod 9 is supported to be rotatable by a supporting member 35 which is rotatably attached to the frame member 10, so that the cylindrical movable member 11 is supported in its entirety by the supporting member 35 to be able to revolve on a central axis thereof passing through the center of the rod 9.

The supporting member 35 has an axis 35*a* which is rotatably engaged with the frame member 10 so that the supporting member 35 is rotatably attached in its entirety to the-frame member 10.

Each of the bullet holding chambers 31 provided in the cylindrical movable member 11 has its central axis extending in parallel with a central axis of the barrel 1 and loaded with a sham bullet BB which is to be shot with gas supplied from the pressure accumulating chamber 30, as described later on. An annular holding member 29 made of elastic material is put in the bullet holding chamber 31. Further, each of the bullet holding chambers 31 is successively positioned with the central axis extending in parallel with the central axis of the barrel 1 to face closely a rear end portion of the barrel 1 in accordance with the revolution of the cylindrical movable member 11 on the central axis of thereof.

Figure 3:
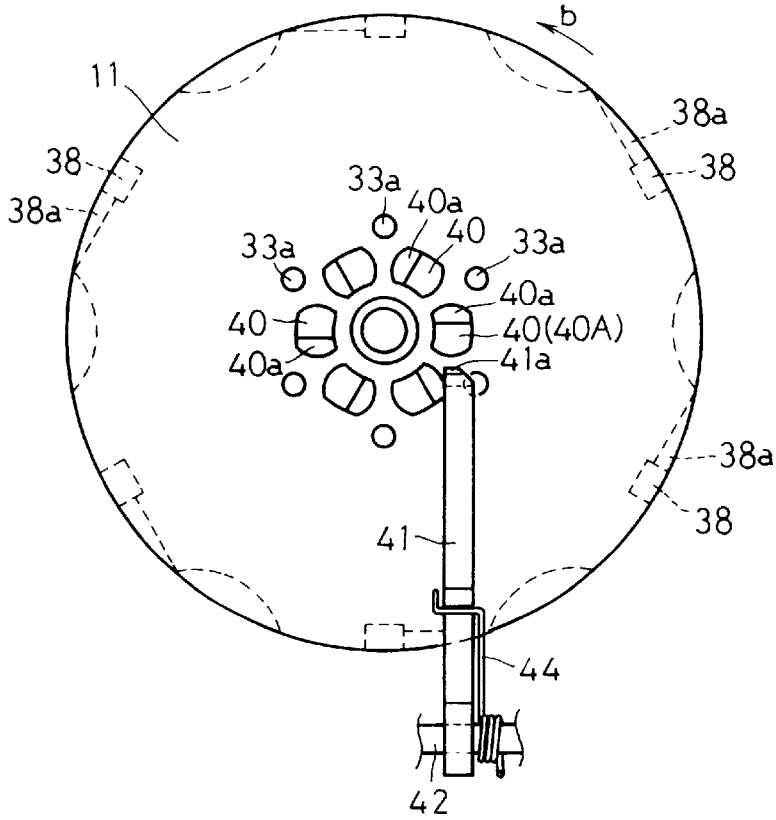
FIG. 3 is a schematic rear view used for explaining the essential portion of the embodiment shown in FIG. 1.

Each of the opening and closing valves 33 in the cylindrical movable member 11 is provided with a rod 33*a* extending linearly from the opening and closing valve 33. A rear end portion of the rod 33*a* projects from a rear end portion of the cylindrical movable member 11 to the outside of the same, as shown in FIG. 3. Each of the opening and closing valves 33 is forced by a coil spring 36 provided in the pressure accumulating chamber 30 to cause the corresponding gas leading passage 32 to be closed.

The gas leading passage 32 has a bent portion adjacent to the corresponding opening and closing valve 33 so that the rod 33*a* extending from the opening and closing valve 33 is positioned out of the central axis of the bullet holding chamber 31 with which the gas leading passage 32 is connected. Accordingly, when one of the bullet holding chambers 31 is positioned to face closely the rear end portion of the barrel 1, the rod 33*a* extending from the opening and closing valve 33 which corresponds to the gas leading passage 32 connected with the bullet holding chamber 31 facing closely the rear end portion of the barrel 1, is positioned out of the central axis of the barrel 1.

When one of the bullet holding chambers 31 is positioned to face closely the rear end portion of the barrel 1, a rear end portion of the rod 33*a* extending from the opening and closing valve 33 which corresponds to the gas leading passage 32 connected with the bullet holding chamber 31 facing closely the rear end portion of the barrel 1, is positioned to be adjacent to a front end portion of a blow suffering member 37 for suffering a blow by the hammer 4 at its rear end portion. The blow suffering member 37 is forced by a spring to tend to go away from the rear end portion of the rod 33*a* positioned to be adjacent to the front end portion of the blow suffering member 37. When the striking portion 4*b* of the hammer 4 strikes the blow at the rear end portion of the blow suffering member 37, as explained later on, the blow suffering member 37 is operative to transmit surely the blow by the hammer 4 through the rod 33*a* to the opening and closing valve 33.

A plurality of curved dents 38 are formed on an outer surface of the cylindrical movable member 11 at predetermined intervals, as shown in FIGS. 2 and 3. The number of these curved dents 38 is the same as that of the bullet holding chambers 31, for example, six. A sloping dent 38*a* is further formed on the outer surface of the cylindrical movable member 11 to extend from each of the curved dents 38.

A plurality of projections 40 are also formed on a rear end surface of the cylindrical movable member 11, as shown in FIG. 3. The number of these projections 40 is also the same as that of the bullet holding chambers 31, for example, six. An ascending and descending member 41 is provided in relation to the projections 40.

Figure 4:
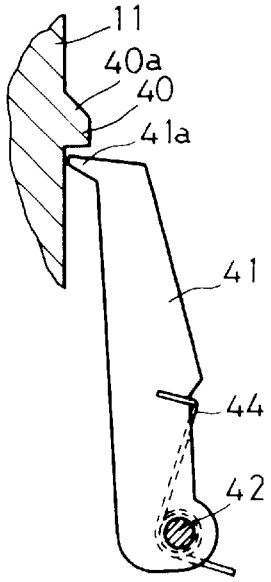
FIG. 4 is a schematic side and partially sectional view used for explaining a projection and an ascending and descending member provided in the embodiment shown in FIG. 1.

The ascending and descending member 41 is connected with the upper part of the trigger 2 to be rotatable with an axis 42 which passes through a lower end portion of the ascending and descending member 41. A contacting portion 41*a* projecting toward the rear end surface of the cylindrical movable member 11 is provided on an upper end portion of the ascending and descending member 41, as shown in FIG. 4. This ascending and descending member 41 is forced by a spring 44 mounted on the axis 42 to cause the contacting portion 41*a* to come into contact with the rear end surface of the cylindrical movable member 11.

The ascending and descending member 41 thus provided is operative to ascend in accordance with the rotation of the trigger 2 from the initial position to the shooting position and to descend in accordance with the rotation of the trigger 2 from the shooting position to the initial position. When the ascending and descending member 41 ascends, the contacting portion 41*a* comes into contact with a lower end portion of the projection 40 and pushes the same up so that the cylindrical movable member 11 is revolved on the central axis thereof to cause one of the bullet holding chambers 31 to face closely the rear end portion of the barrel 1.

The position of the ascending and descending member 41 in relation to the projections 40 provided on the rear end surface of the cylindrical movable member 11 is set so as to revolve the cylindrical' movable member 11, for example, in a direction indicated by an arrow "b" in FIG. 3 ("b" direction). Therefore, the cylindrical movable member 11 which contains the pressure accumulating chamber 30, the bullet holding chambers 31, the gas leading passages 32 and the opening and closing valves 33 is revolved in its entirety around the central axis thereof at every predetermined revolving angle to cause successively each of the bullet holding chambers 31 to face closely the rear end portion of the barrel 1.

Each of the projections 40 provided on the rear end surface of the cylindrical movable member 11 has a slope 40*a*, as shown in FIG. 4. The contacting portion 41*a* of the ascending and descending member 41, which is operative to push the projection 40 up so that the cylindrical movable member 11 is revolved on the central axis thereof when the ascending and descending member 41 ascends, comes into contact with the slope 40*a* of the projection 40 to move down without moving the projection 40 when the ascending and descending member 41 descends.

The positioning member 16 provided in the vicinity of the trigger 2 engages selectively with one of the curved dents 38 formed on the outer surface of the cylindrical movable member 11. The positioning member 16 has a curved projection 16*b* and a recess 16*c* and is forced by a spring to cause the curved projection 16*b* to come into contact with the outer surface of the cylindrical movable member 11. The front projection 2*a* of the trigger 2 engages with the recess 16*c* of the positioning member 16 so that the positioning member 16 is connected with the trigger 2 when the trigger 2 takes the initial position.

The positioning member 16 thus connected with the trigger 2 taking the initial position is operative selectively in response to the positions of the trigger 2 to cause the curved projection 16*b* to engage through one of the sloping dents 38*a* with one of the curved dents 38 formed on the outer surface of the cylindrical movable member 11 for preventing the cylindrical movable member 11 from revolving on the central axis thereof and to cause the curved projection 16*b* to go away from the curved dent 38 for enabling the cylindrical movable member 11 to revolve on the central axis thereof.

When the cylindrical movable member 11 is prevented from revolving by the positioning member 16, one of the bullet holding chambers 31 provided in the cylindrical movable member 11 is positioned to face closely the rear end portion of the barrel 1. Accordingly, the curved dents 38 and the positioning member 16 constitute a control mechanism which is operative to keep the cylindrical movable member 11 in a locked condition wherein one of the bullet holding chambers 31 is positioned to face closely the rear end portion of the barrel 1 and to release the cylindrical movable member 11 from the locked condition so as to be revolved on the central axis thereof selectively in response to positions of a trigger 2.

Figure 5:
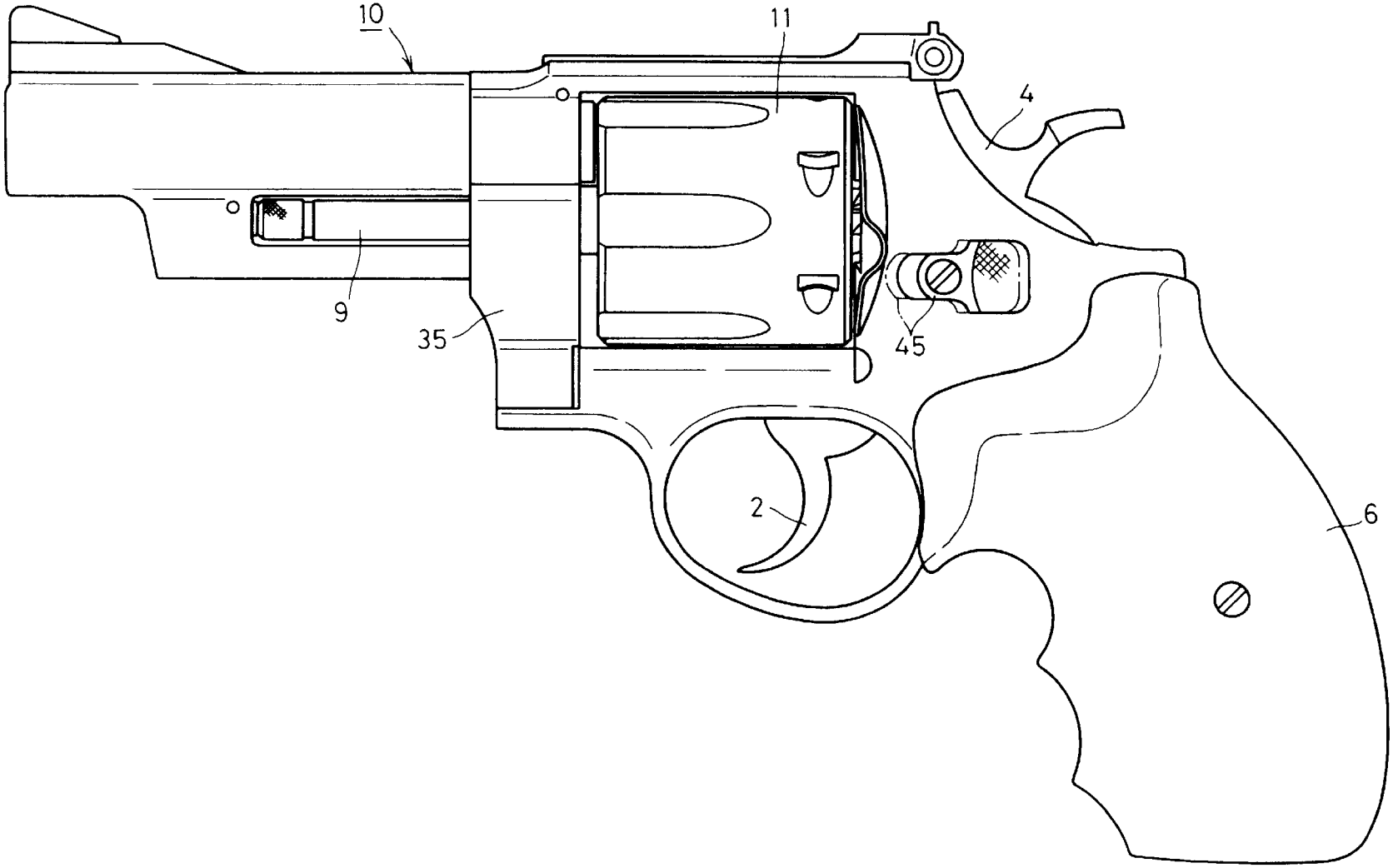
FIG. 5 is a schematic side view showing the external appearance of the embodiment shown in FIG. 1.

A rotation prohibiting member 45 which is operative selectively to prohibit the supporting member 35 for supporting the cylindrical movable member 11 from rotating and allow the supporting member 35 to rotate in relation to the frame member 10, is provided on the frame member 10, as shown in FIG. 5. The rotation prohibiting member 45 is moved by a manual operation to take selectively a locking position as indicated with a solid line in FIG. 5 and a releasing position which is nearer to the cylindrical movable member 11 than the locking position as indicated with a dot-dash line in FIG. 5.

Figure 6:
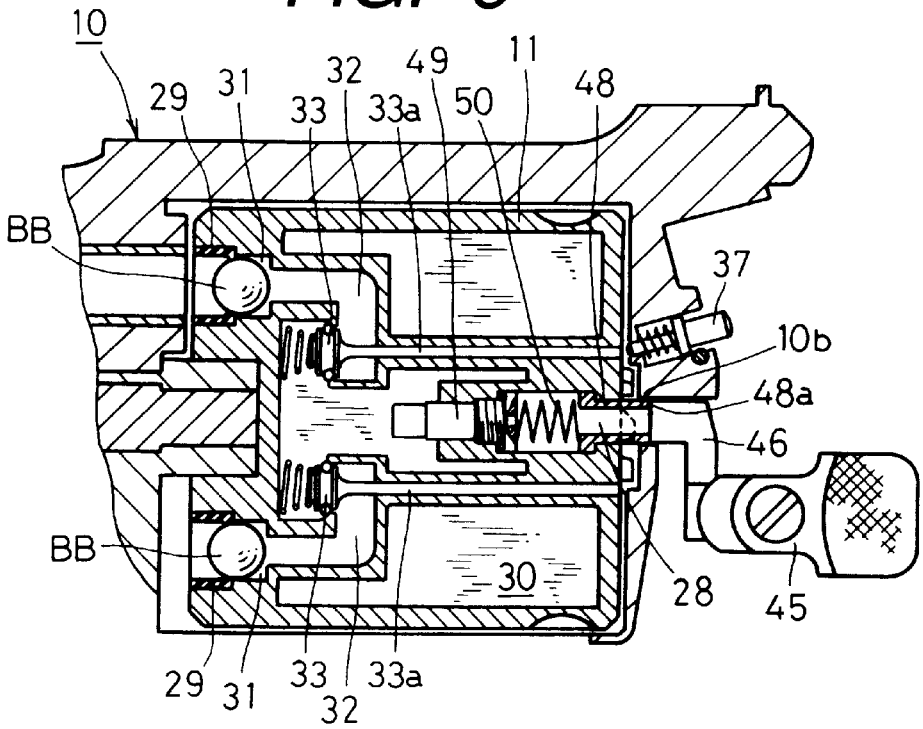
FIGS. 6 and 7 are partial cross sectional views used for explaining the structure and operation of the essential portion of the embodiment shown in FIG. 1.
Figure 7:
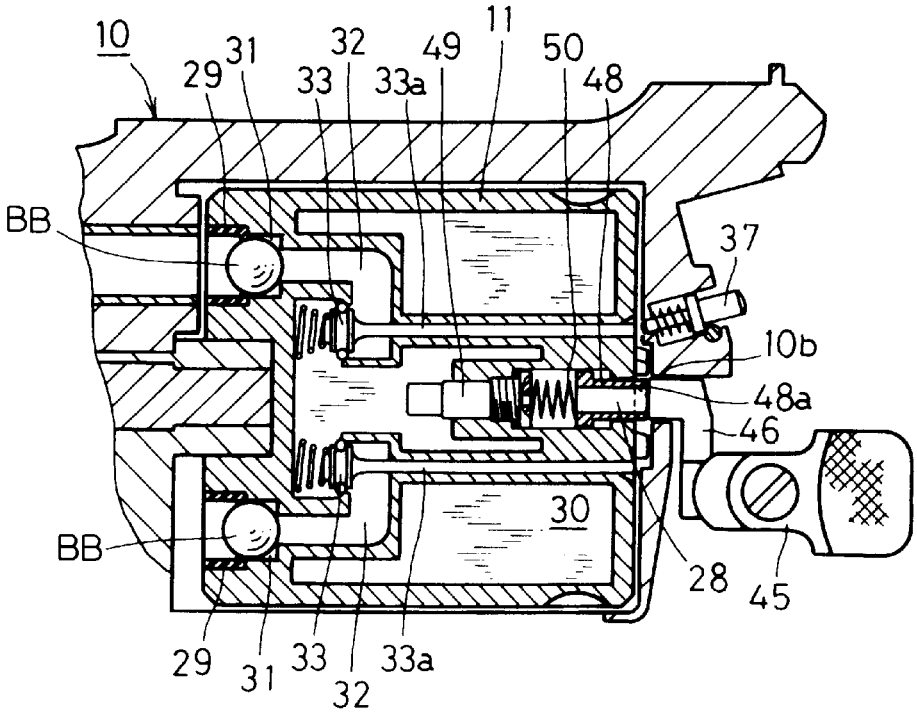

A pushing member 46 engages with the rotation prohibiting member 45, as shown in FIGS. 6 and 7. The pushing member 46 is operative to push a tubular member 48 provided in the cylindrical movable member 11. The tubular member 48 is positioned to be opposite to a gas introducing member 49 in the cylindrical movable member 11 and forced by a spring 50 provided between the tubular member 48 and the gas introducing member 49 to cause an end portion 48*a* thereof to project from the cylindrical movable member 11 to the outside of the same. The tubular member 48 and the gas introducing member 49 constitute the gas injecting port 28.

Figure 8:
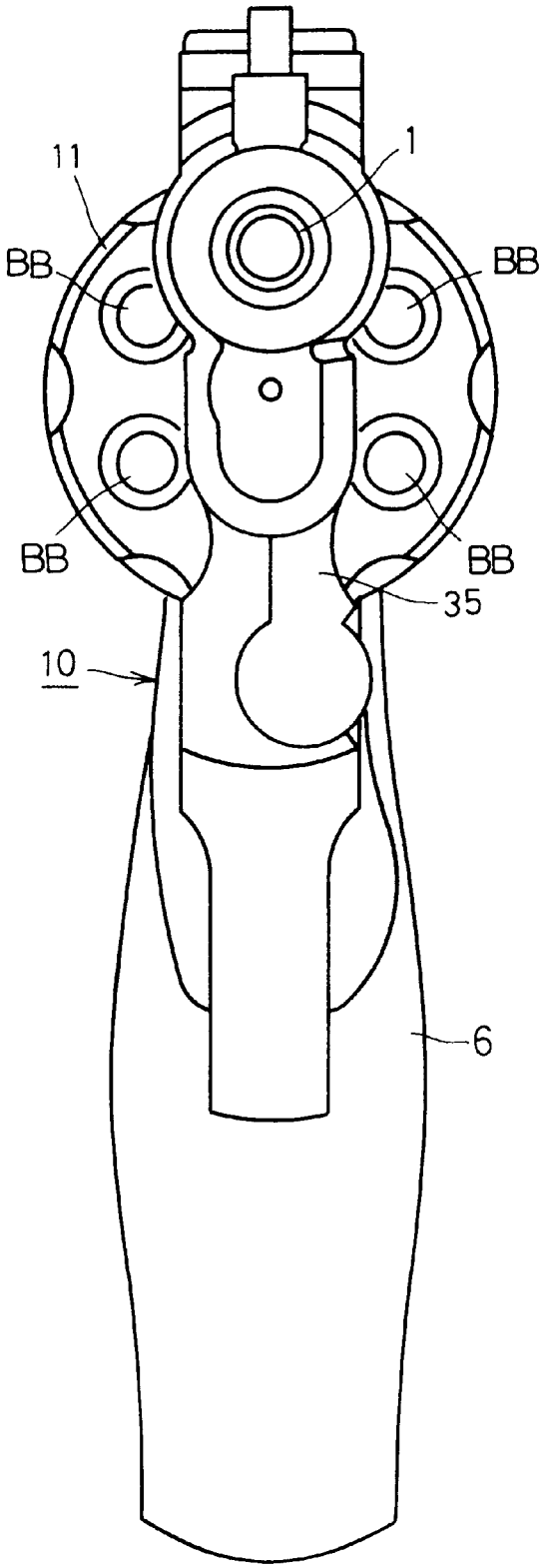
FIGS. 8 and 9 are schematic front views used for explaining the operation of the embodiment shown in FIG. 1.

When the cylindrical movable member 11 is mounted on the frame member 10 as shown in FIG. 8 and the rotation prohibiting member 45 is caused to take the locking position, the end portion 48*a* of the tubular member 48 is caused by the spring 50 to project from the cylindrical movable member 11 to the outside of the same and to engage with a hollow 10*b* formed on the frame member 10, so that the cylindrical movable member 11 is secured to the frame member 10, as shown in FIG. 6.

When the cylindrical movable member 11 is mounted on the frame member 10 and the rotation prohibiting member 45 is caused to take the releasing position, the tubular member 48 is pushed by the pushing member 46 coming into contacting with the end portion 48*a* in the direction against the elastic force of the spring 50 to come into the cylindrical movable member 11 and the end portion 48*a* of the tubular member 48 disengages from the hollow 10*b*, so that the cylindrical movable member 11 is released from such a condition as to be secured to the frame member 10, as shown in FIG. 7.

Accordingly, when the rotation prohibiting member 45 is caused to take the locking position and the cylindrical movable member 11 is secured to the frame member 10, the supporting member 35 for supporting the cylindrical movable member 11 is prohibited from rotating in relation to the frame member 10. To the contrary, when the rotation prohibiting member 45 is caused to take the releasing position and the cylindrical movable member 11 is released from such condition as to be secured to the frame member 10, the supporting member 35 for supporting the cylindrical movable member 11 is able to rotate in relation to the frame member 10.

Figure 9:
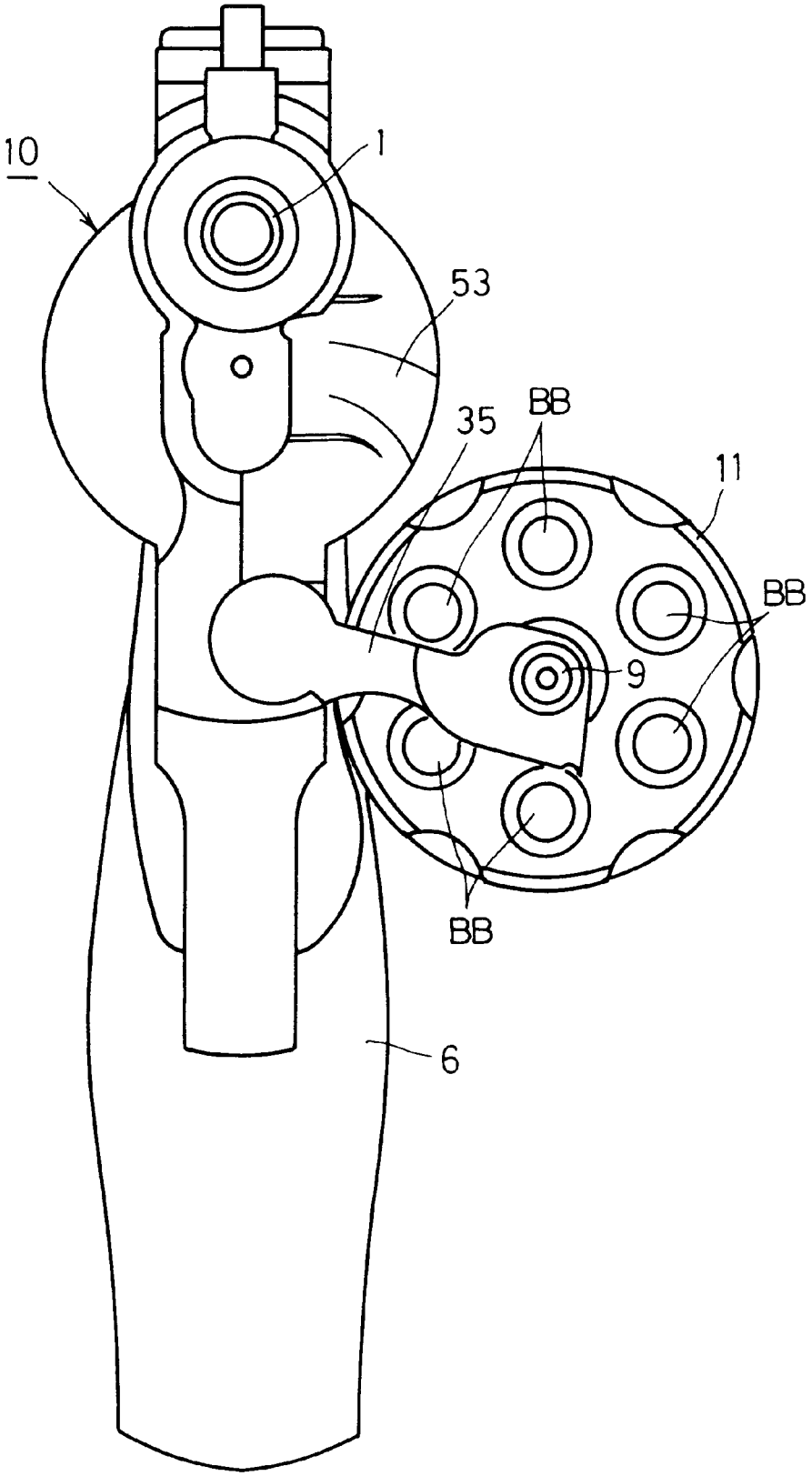

When the supporting member 35 is rotated, together with the cylindrical movable member 11, in a first direction in relation to the frame member 10, the cylindrical movable member 11 mounted on the frame member 10 as shown in FIG. 8 is removed from frame member 10 to a swung out position as shown in FIG. 9. That is, a swing out operation of the cylindrical movable member 11 is performed. Then, the supporting member 35 is rotated, together with the cylindrical movable member 11, in a second direction reverse to the first direction in relation to the frame member 10, the cylindrical movable member 11 placed at the swung out position as shown in FIG. 9 is returned to be mounted on the frame member 10 as shown in FIG. 8.

The rotation prohibiting member 45 operates selectively to prohibit the supporting member 35 for supporting the cylindrical movable member 11 from rotating and allow the supporting member 35 to rotate in relation to the frame member 10, the pushing member 46 engaging with the rotation prohibiting member 45, and the tubular member 48 constituting the gas injecting port 28 to the pressure accumulating chamber 30 provided in the cylindrical movable member 11 constitute a movable mechanism which operates selectively to keep the cylindrical movable member 11 on the frame member 10 and to allow the cylindrical movable member 11 to be removed from the frame member 10 to the swung out position.

With the cylindrical movable member 11 placed at the swung out position as shown in FIG. 9 in such a manner as described above, the bullet holding chambers 31 provided in the cylindrical movable member 11 are easily and surely loaded with the sham bullets BB.

Figure 10:
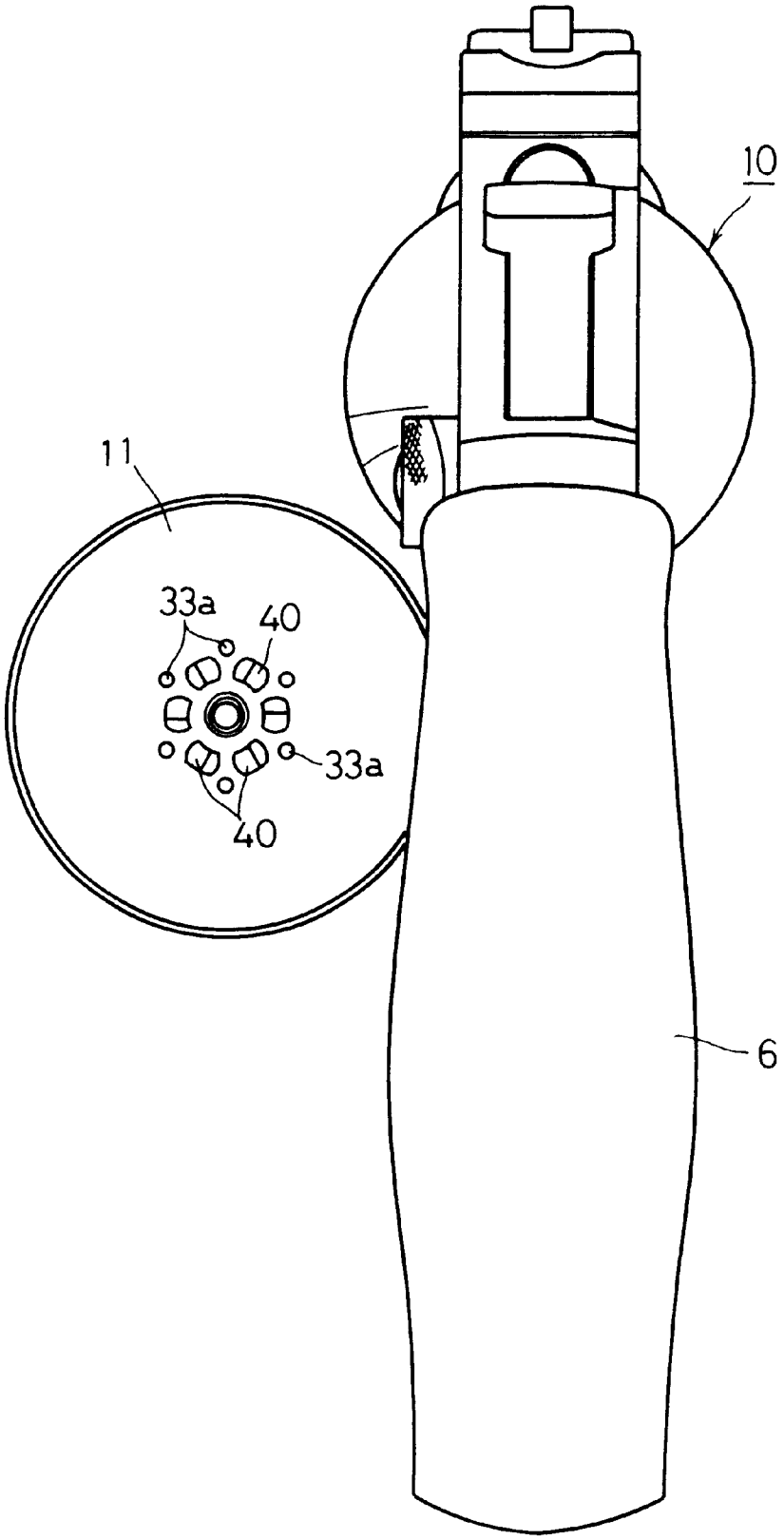
FIG. 10 is a rear view used for explaining the operation of the embodiment shown in FIG. 1.
Figure 11:
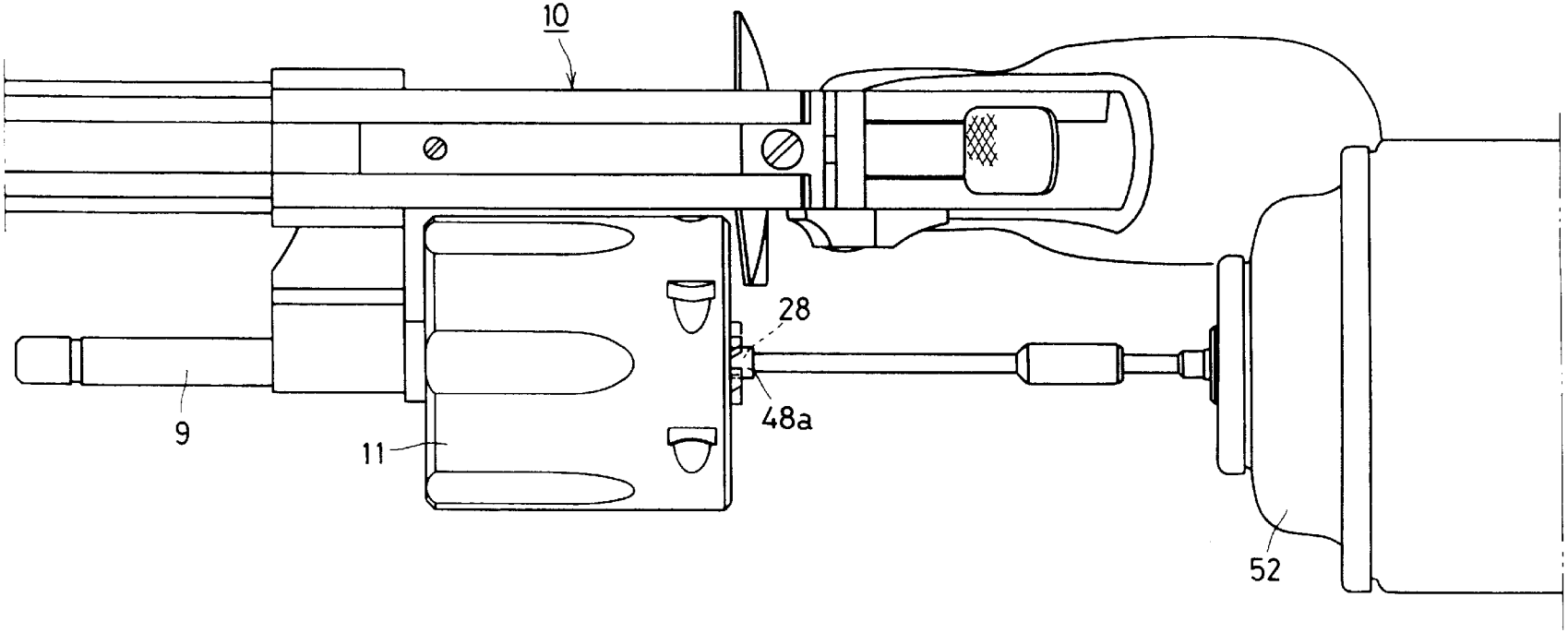
FIG. 11 is a plane view used for explaining the operation of the embodiment shown in FIG. 1.
Figure 12:
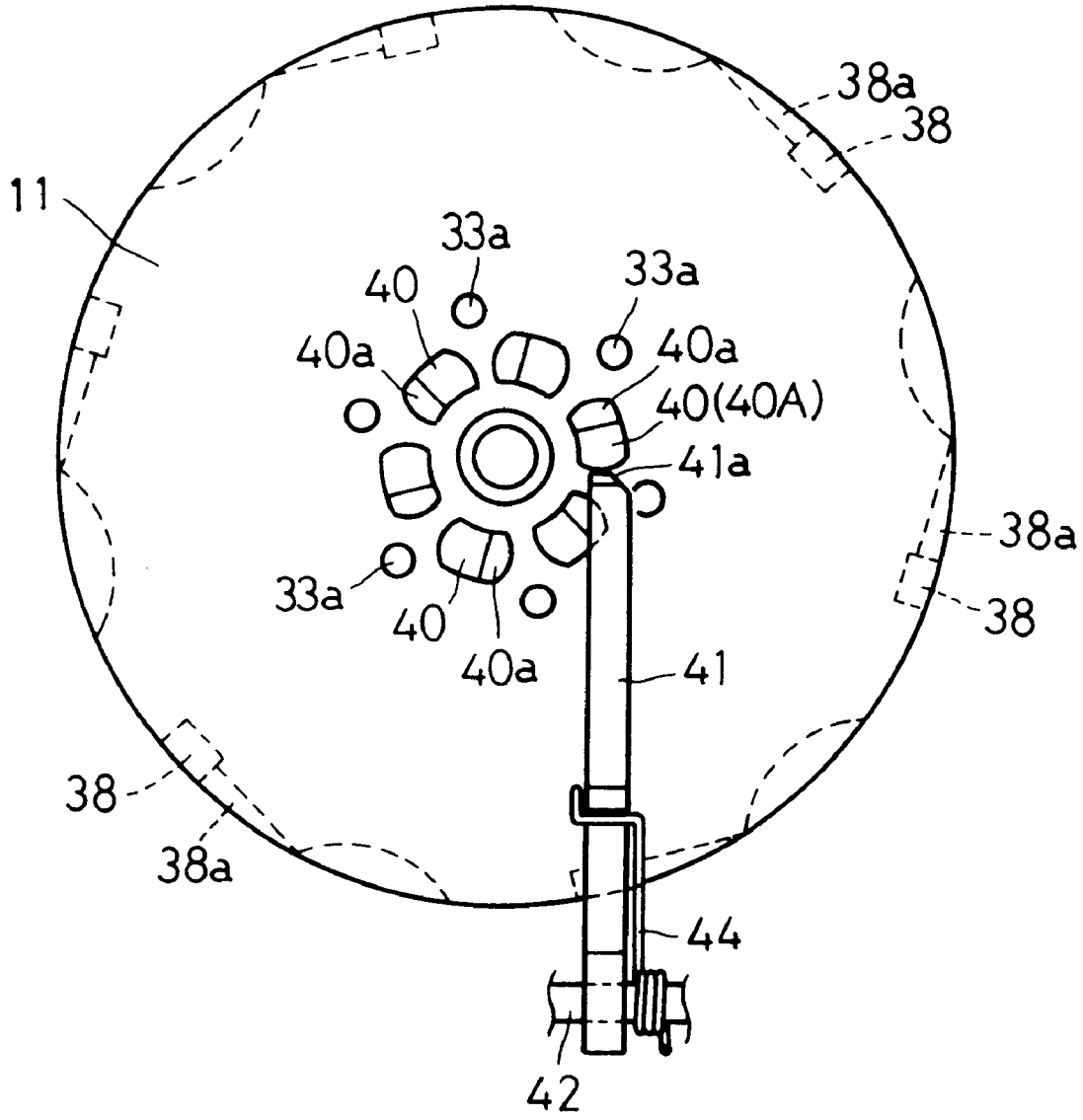
FIG. 12 is a rear view used for explaining the operation of the embodiment shown in FIG. 1.

When the cylindrical movable member 11 is placed at the swung out position, the tubular member 48 which constitutes the gas injection port 28 and the movable mechanism is forced by the spring 50 to have the end portion 48*a* thereof which projects from the cylindrical movable member 11 to the outside of the same, so that the gas injection port 28 is exposed to the outside of the cylindrical movable member 11. Therefore, with the cylindrical movable member 11 placed at the swung out position as shown in FIGS. 10 and 11, the pressure accumulating chamber 30 provided in the cylindrical movable member 11 is easily and surely charged through the gas injection port 28 with liquefied gas by means of a gas bomb 52 as shown in FIGS. 11.

Incidentally, the frame member 10 is provided with a guiding portion 53, as shown in FIG. 9. When the cylindrical movable member 11 is moved from the swung out position to be mounted on the frame member 10, the end portion 48*a* of the tubular member 48 which is forced by the spring 50 to project from the cylindrical movable member 11 to the outside of the same comes into contact with the guiding portion 53 to be guided thereby so that the cylindrical movable member 11 is surely moved to be mounted on the frame member 10.

In the first embodiment described above, when the sham bullet BB put in one of the bullet holding chambers 31 provided in the cylindrical movable member 11 is shot, the trigger 2 taking the initial position is manually pulled under a condition wherein the movable mechanism keeps the cylindrical movable member 11 on the frame member 10, the control mechanism keeps the cylindrical movable member 11 in the locked condition wherein one of the bullet holding chambers 31 is positioned to face closely the rear end portion of the barrel 1, and the hammer 4 takes the initial position.

In such a condition, the tubular member 48 is forced by the spring 50 to cause the end portion 48*a* thereof to project from the cylindrical movable member 11 to the outside of the same and engage with the hollow 10*b* provided on the frame member 10 so that the cylindrical movable member 11 is secured to the frame member 10. Each of the opening and closing valves 33 contained in the cylindrical movable member 11 keeps the corresponding gas leading passage 32 closed.

The blow suffering member 37 is put in such a condition as to have its front end portion positioned to be adjacent to the rear end portion of the rod 33*a* extending from the opening and closing valve 33 which keeps the gas leading passage 32 connected the bullet holding chamber 31 facing closely the rear end portion of the barrel 1 closed. The hammer strut 22 is placed at an upper position with the lower end portion thereof engaging with the stopper 25 provided in the grip 6. The hammer 4 connected with the hammer strut 22 takes the initial position to have the movable portion 4*a* being in contact with the read end portion of the frame member 10, the striking portion 4*b* positioned to be adjacent to the blow suffering portion 37, the projection 4*c* being in contact with the lower surface of the rear projection 2*b* of the trigger 2 and its lower end portion being in contact with the sliding member 13. The rotatable member 20 provided on the hammer 4 is put in such a condition as to have the upper contacting portion 20*a* being in contact with the hammer 4 taking the initial position and the lower contacting portion 20*b* being in contact with the upper surface of the rear projection 2*b* of the trigger 2 taking the initial position.

The positioning member 16 constituting the control mechanism is put in such a condition as to have the recess 16*c* which engages with the front projection 2*a* of the trigger 2 so that the positioning member 16 is connected with the trigger 2, and the curved projection 16*b* which engages with one of the curved dents 38 provided on the outer surface of the cylindrical movable member 11, for example, a curved dent 38A shown in FIG. 2, so that the cylindrical movable member 11 is put in the locked condition wherein one of the bullet holding chambers 31 is positioned to face closely the rear end portion of the barrel 1.

The ascending and descending member 41 which is connected with the trigger 2 at the initial position is caused to take the lower position so as to have the contacting portion 41*a* positioned to oppose the lower end portion of one of the projections 40, for example, a projection 40A shown in FIG. 3, provided on the rear end surface of the cylindrical movable member 11.

Under such a situation as aforementioned, when the trigger 2 taking the initial position is manually pulled, the trigger 2 is rotated in a direction against the elastic force of the spring 14 to be accompanied with the sliding member 13 moving backward and the manual operation to the trigger 2 is transmitted through the rotatable member 20 to the hammer 4, so that the hammer 4 is rotated in the "a" direction from the initial position and the lower end portion of the hammer 4 is removed from the sliding member 13.

The positioning member 16 connected with the trigger 2 is rotated in a direction against the elastic force of the spring acting on the positioning member 16, namely, in the direction for releasing the curved projection 16*b* from the engagement with the curved dent 38A on the outer surface of the cylindrical movable member 11. With such a rotation of the positioning member 16, the cylindrical movable member 11 is released from the locked condition wherein the cylindrical movable member 11 is prevented from revolving on the central axis thereof and a bullet holding chamber 31A is positioned to face closely the rear end portion of the barrel 1, so as to be able to revolve on the central axis thereof. Then, the ascending and descending member 41 connected with the trigger 2 ascends from its lower position to its upper position to cause the contacting portion 41*a* to come into contact with the lower surface of the projection 40A provided on the rear end surface of the cylindrical movable member 11 for pushing the projection 40A up and thereby causing the cylindrical movable member 11 to revolve on the cylindrical movable member 11 rotating in the "b" direction and thereby keep the cylindrical movable member 11 in the locked condition wherein a bullet holding chamber 31B (shown in FIG. 11) next to the bullet holding chamber 31A is positioned to face closely the rear end portion of the barrel 1.

Figure 13:
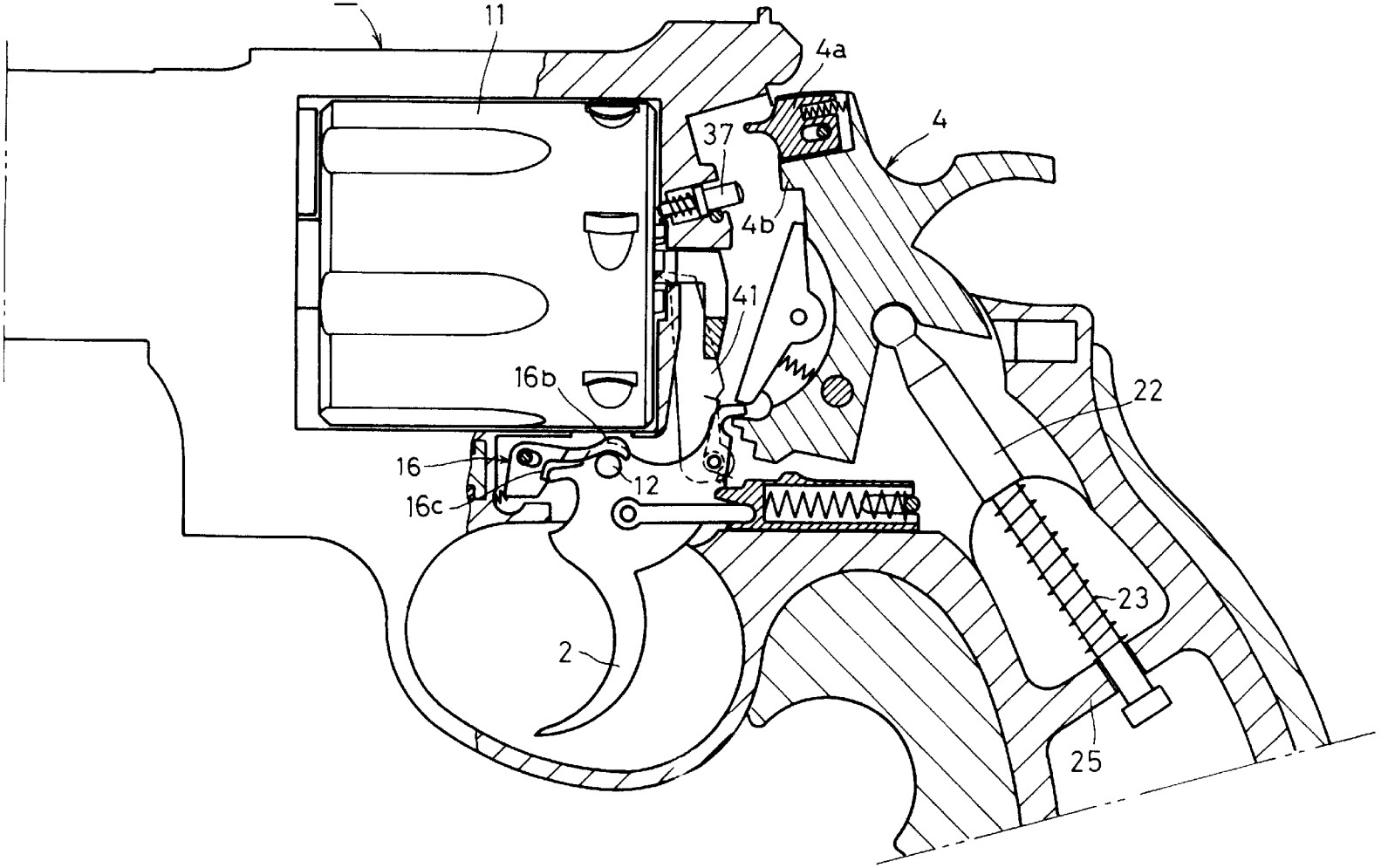
FIGS. 13, 14 and 15 are partial side and cross sectional views used for explaining the operation of the embodiment shown in FIG. 1.

With the rotation of the hammer 4 in the a direction, the movable portion 4*a* of the hammer 4 is caused to go away from the rear end portion of the frame member 10 and the striking portion 4*b* of the hammer 4 is also caused to go away from the blow suffering member 37, as shown in FIG. 13. Further, the hammer strut 22 is pushed down by the hammer 4 to compress the coil spring 23.

As described above, the rotation of the hammer 4 from the initial position thereof and the revolution of the cylindrical movable member 11 on the central axis thereof are started in response to the manual operation to the trigger 2.

Figure 14:
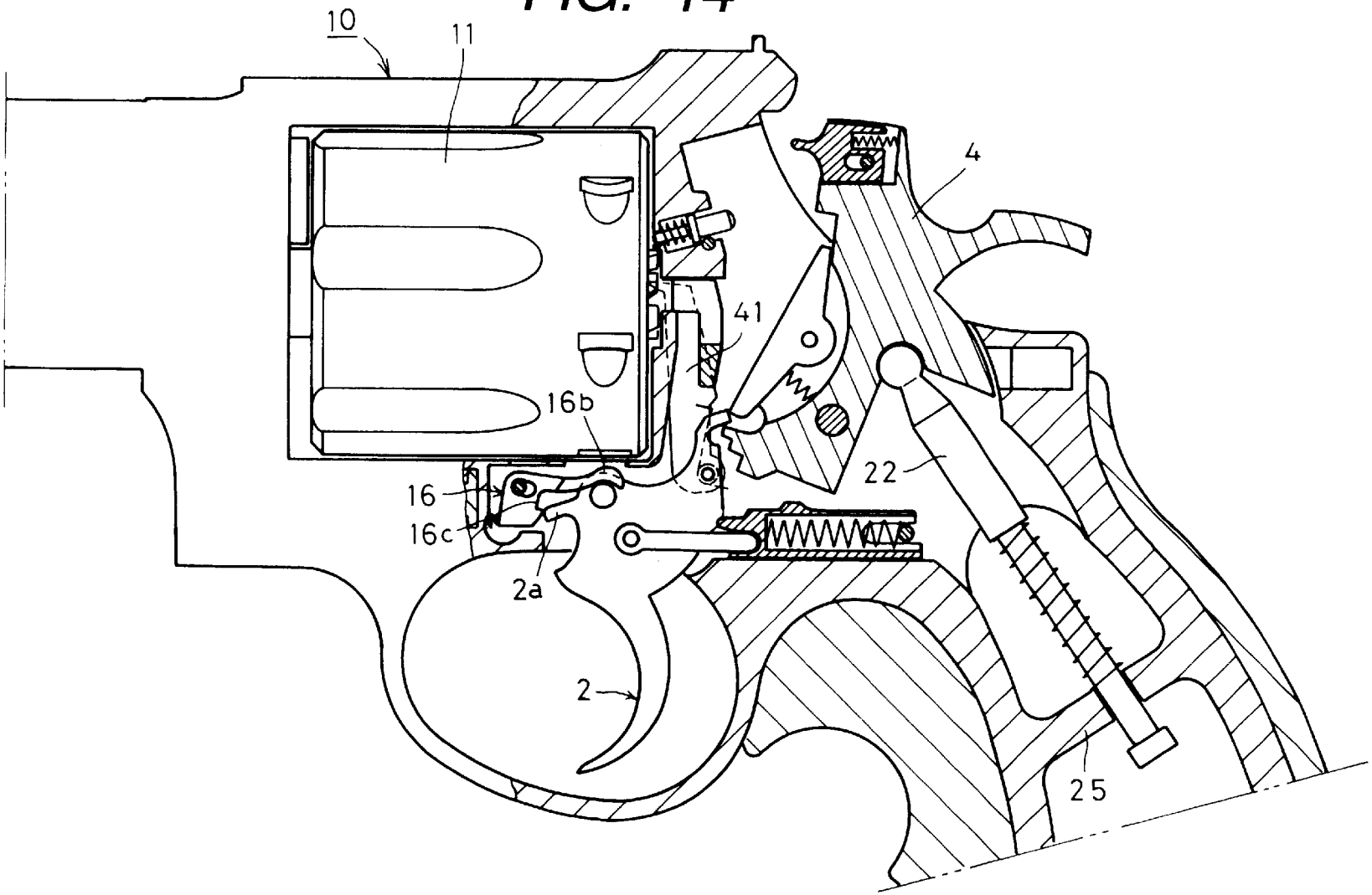
Figure 15:
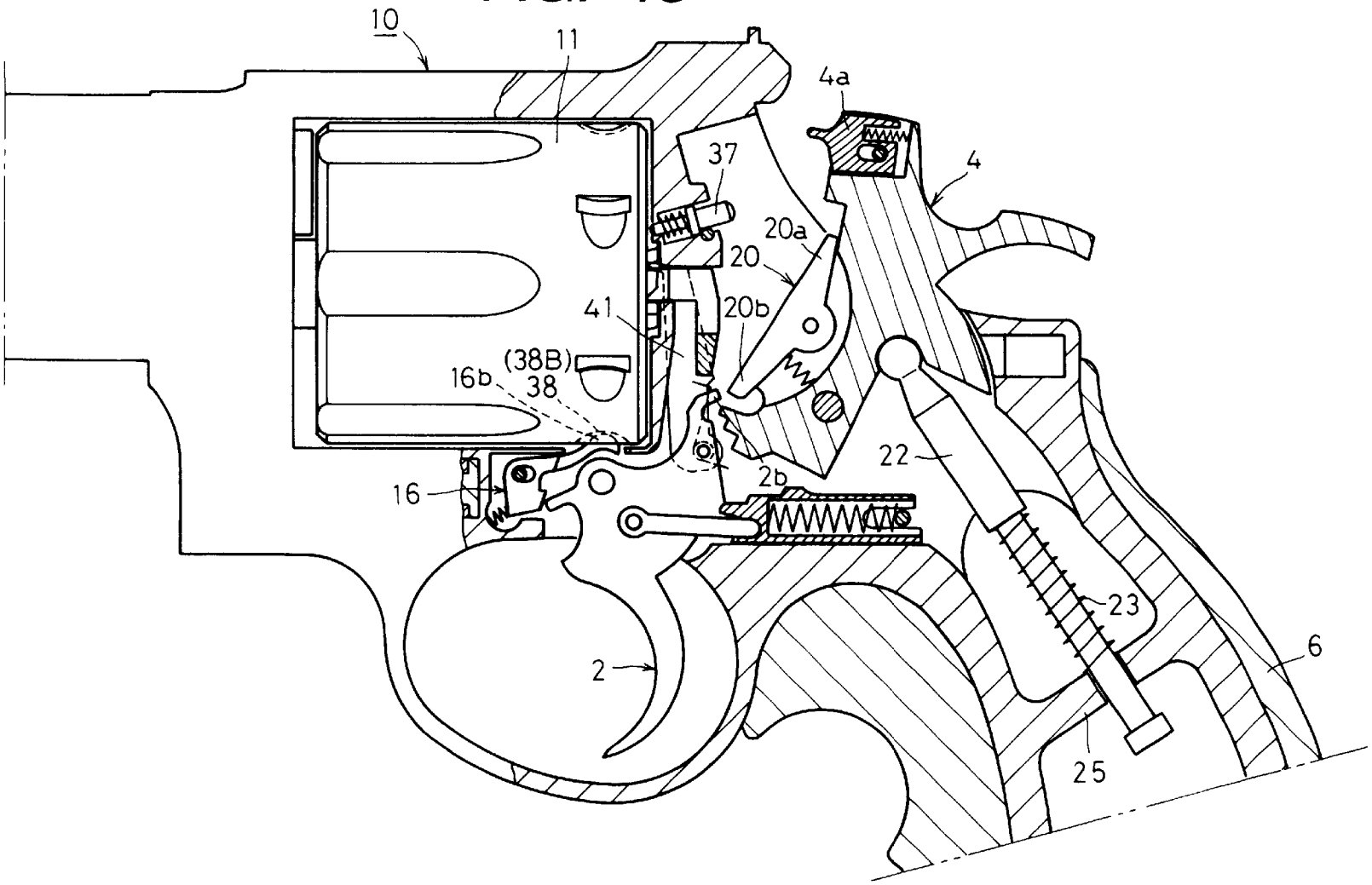

Under a situation wherein the rotation of the hammer 4 in the a direction which causes the hammer strut 22 to move down and the ascent of the ascending and descending member 41 which causes the cylindrical movable member 11 to revolve on the central axis thereof continue, when the trigger 2 is rotated to reach a first predetermined position as shown in FIG. 14, the recess 16*c* of the positioning member 16 is released from the engagement with the front projection 2*a* of the trigger 2 and the positioning member 16 starts rotating in a direction in accordance with the elastic force of the spring acting on the positioning member 16. When the trigger 2 is further rotated from the first predetermined position to reach a second predetermined position as shown in FIG. 15, the positioning member 16 is operative to cause the curved projection 16*b* to engage with a curved dent 38B next to the curved dent 38A provided on the cylindrical movable member 11 rotating in the b direction and thereby to keep the cylindrical movable member 11 in the locked condition wherein a bullet holding chamber 31B (shown in FIG. 17) next to the bullet holding chamber 31A is positioned to face closely the rear end portion of the barrel 1.

Figure 16:
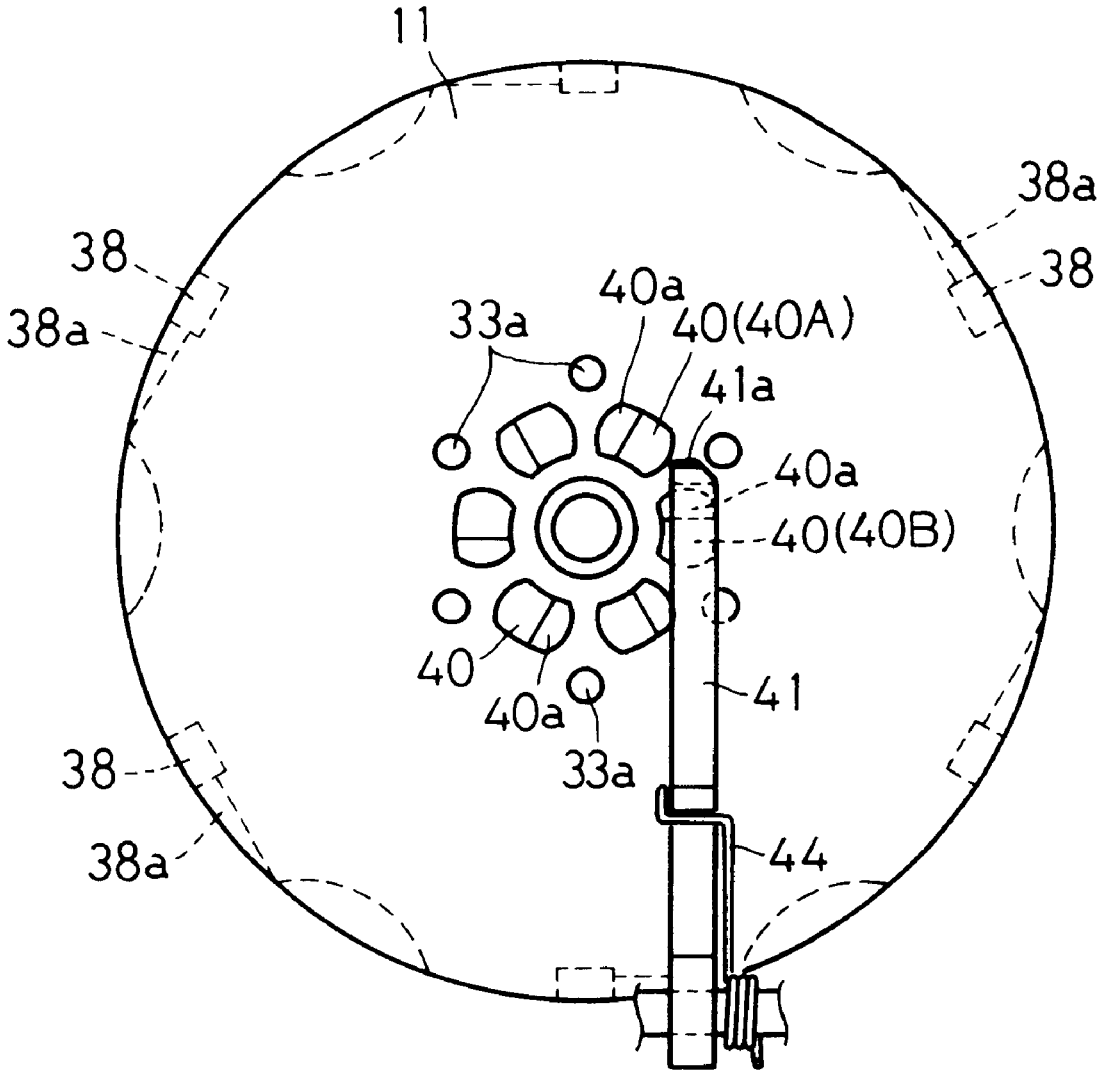
FIG. 16 is a rear view used for explaining the operation of the essential portion of the embodiment shown in FIG. 1.

When the trigger 2 has reached to the second predetermined position, the ascending and descending member 41 takes the upper position as shown in FIG. 16 and the lower contacting portion 20*b* of the rotatable member 20 is released from engagement with the rear projection 2*b* of the trigger 2, so that the manual operation to the trigger 2 is not transmitted to the hammer 4. Therefore, the coil spring 23 is shifted from its compressed condition to its expanded condition and the hammer strut 22 is pushed up to cause the hammer 4 to rotate in the direction reverse to the "a" direction and return to the initial position.

The ascending and descending member 41 constitutes a driving mechanism which is operative to cause the cylindrical movable member 11 mounted on the frame member 10 to revolve on the central axis thereof in accordance with the manual operation to the trigger 2 when the positioning member 16 constituting the control mechanism releases the cylindrical movable member 11 from the locked condition.

In such a situation, the front end portion of the blow suffering member 37 is adjacent to the rear end portion of the rod 33*a* extending from the opening and closing valve 33B (shown in FIG. 17) which corresponds to the gas leading passage 32 connected with the bullet holding chamber 31B positioned to face closely the rear end portion of the barrel 1.

When the hammer strut 22 has reached the upper position at which the lower end portion of the hammer strut 22 comes into contact with the stopper 25 provided in the grip 6, the hammer 4 continues to rotate in a direction reverse to the "a" direction by way of inertia. With such rotation of the hammer 4 in the direction reverse to the "a" direction by way of inertia, the movable portion 4*a* of the hammer 4 which is in contact with the rear end portion of the frame member 10 moves in a direction against the elastic force of the spring acting on the movable portion 4*a*. Then, the trigger 2 has just reached the shooting position as shown in FIG. 17, the striking portion 4*b* of the hammer 4 strikes a blow at the rear end portion of the blow suffering member 37 to move the blow suffering member 37 in a direction against the elastic force of the spring acting on the blow suffering member 37.

With such movement of the blow suffering member 37, the blow by the hammer 4 is transmitted through the blow suffering member 37 to the rear end portion of the rod 33*a* extending from the opening and closing valve 33B. Accordingly, the rear end portion of the rod 33*a* specifies substantially a portion for suffering the blow by the hammer 4. The rear end portion of the rod 33*a* extending from the opening and closing valve 33B which corresponds to the gas leading passage 32 connected with the bullet holding chamber 31B positioned to face closely the rear end portion of the barrel 1, is positioned out of the central axis of the bullet holding chamber 31B and therefore positioned out of the central axis of the barrel 1. Consequently, the portion for suffering the blow by the hammer 4, which is specified by the rear end portion of the rod 33*a* extending from the opening and closing valve 33B is positioned out of the central axis of the barrel 1.

The opening and closing valve 33B provided with the rod 33*a* to which the blow by the hammer 4 is transmitted through the blow suffering member 37, is moved in the direction against the elastic force of the coil spring 36 acting on the opening and closing valve 33B to cause the gas leading passage 32 connected with the bullet holding chamber 31B to open into the pressure accumulating chamber 30 so that the bullet holding chamber 31B is led through the opening and closing valve 33B to the pressure accumulating chamber 30. As a result, the gas pressure is supplied to the bullet holding chamber 31B through the gas leading passage 32 from the pressure accumulating chamber 30 to act on the sham bullet BB put therein. Since the gas leading passage 32 which leads the gas pressure from the pressure accumulating chamber 30 to the bullet holding chamber 31B is formed to be relatively short in its entirety, the gas pressure supplied to the bullet holding chamber 31B from the pressure accumulating chamber 30 acts on the sham bullet BB put in the bullet holding chamber 31B with enough pressure value.

Figure 17:
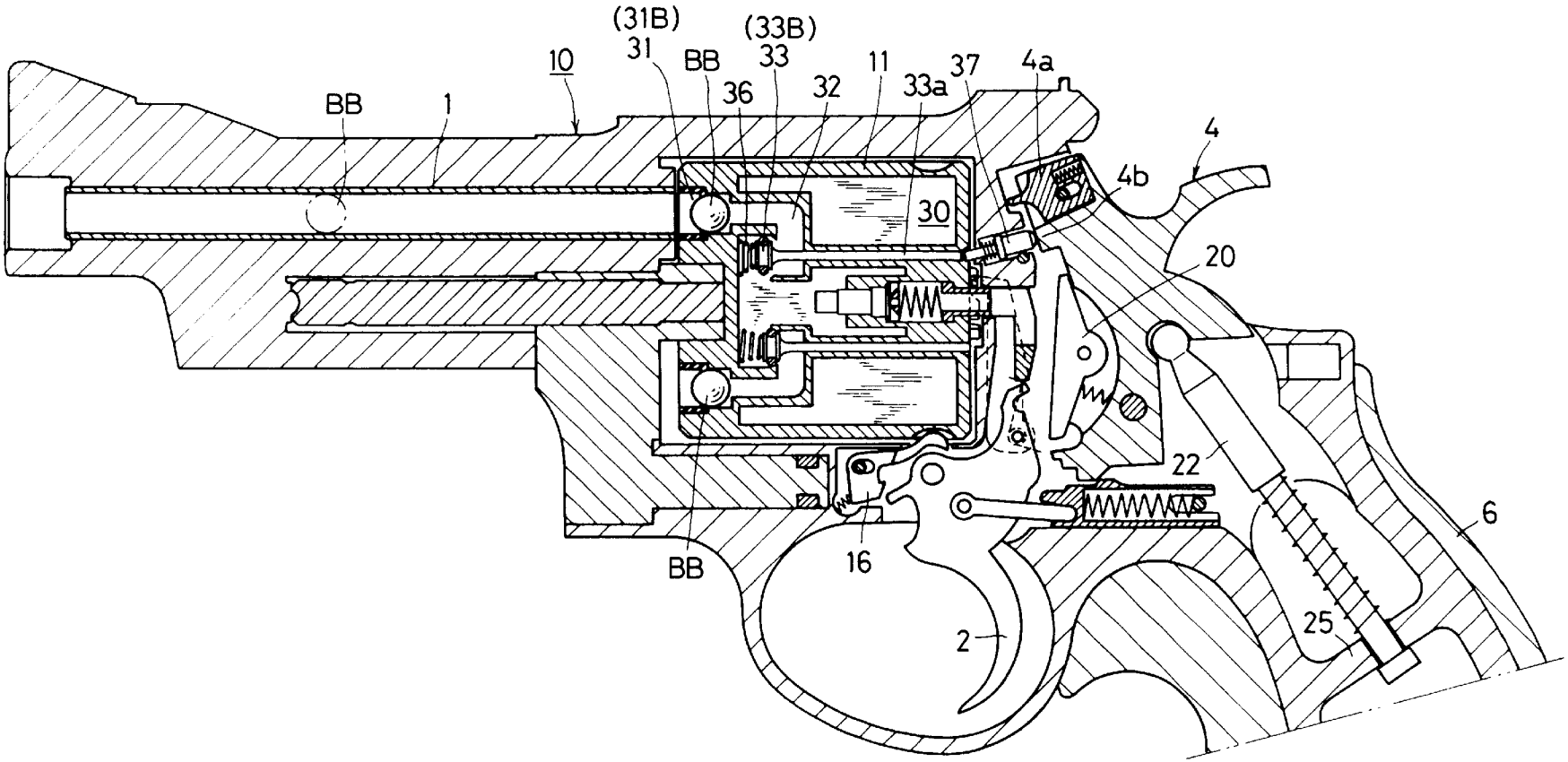
FIGS. 17, 18, 19, 20 and 21 are partial cross sectional views used for explaining the operation of the embodiment shown in FIG. 1.

The sham bullet BB put in the bullet holding chamber 31B is forcibly moved into the barrel 1 from the bullet holding chamber 31B with the gas pressure having enough pressure value, as indicated with a dot-dash line in FIG. 17. Then, the sham bullet BB is accelerated to move forward in the barrel 1 by the gas pressure flowing into the barrel through the bullet holding chamber 31B and the gas leading passage 32 from the pressure accumulating chamber 30 and shot from a muzzle at a front end portion of the barrel 1.

Figure 18:
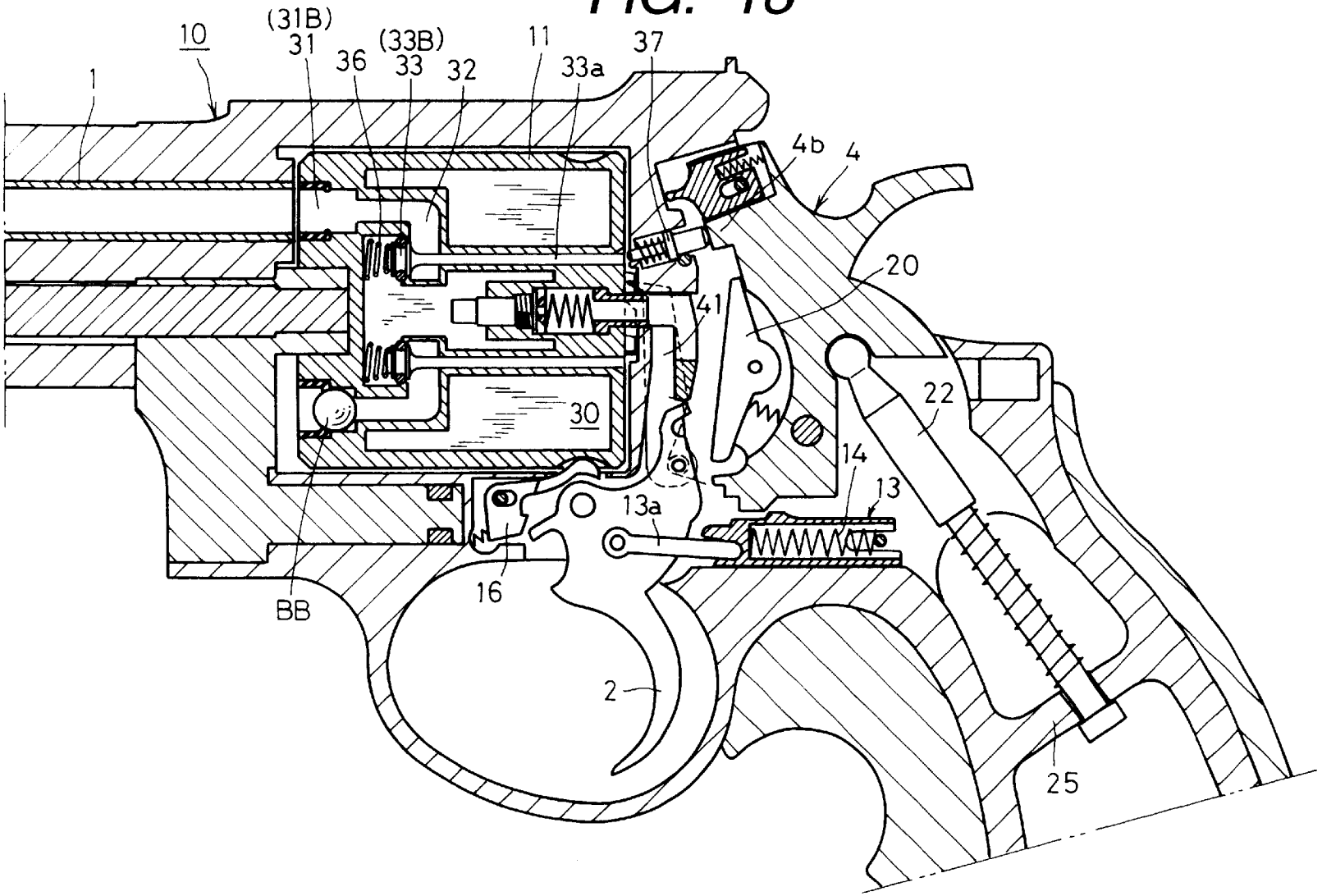

Simultaneously with the shot of the sham bullet BB from the muzzle, the hammer 4 returns to the initial position, the blow suffering member 37 moves in the direction according to the elastic force of the spring acting on the blow suffering member 37 and the opening and closing valve 33B moves also in the direction according to the elastic force of the coil spring 36 acting on the opening and closing valve 33B. As a result, the gas leading passage 32 connected with the bullet holding chamber 31B is closed for shutting off the gas pressure supplied to the bullet holding chamber 31B from the pressure accumulating chamber 30, as shown in FIG. 18. The trigger 2 is rotated to the initial position from the shooting position by the elastic force of the spring 14 acting on the trigger 2. With such rotation of the trigger 2, the ascending and descending member 41 connected with the trigger 2 is moved down and the sliding member 13 is moved forward.

During the downward movement of the ascending and descending member 41, the contacting portion 41*a* of the ascending and descending member 41 comes into contact with a slope 40*a* provided to a projection 40B next to the projection 40A on the rear end surface of the cylindrical movable member 11 and is moved in the direction against the elastic force of the spring 44 and downward so as to ride across the projection 40B, as shown in FIG. 16.

Figure 19:
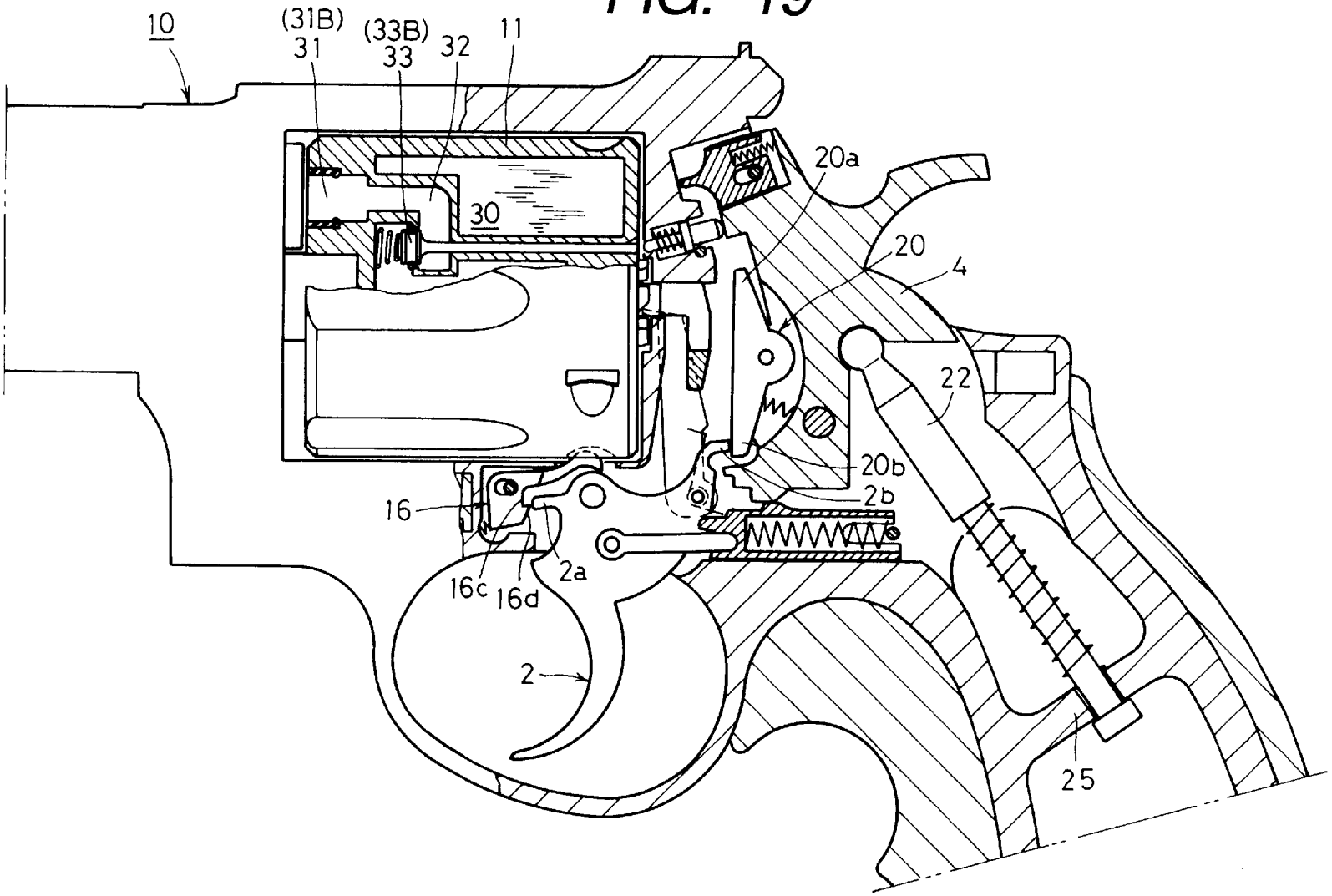

The trigger 2 continues its rotation to return to the initial position. During such rotation of the trigger 2, the front projection 2*a* of the trigger 2 comes into contact with a slanting portion 16*d* of the positioning member 16 which keeps the cylindrical movable member 11 in the locked condition wherein the bullet holding chamber 31B is positioned to face closely the rear end portion of the barrel 1 and is guided by the slanting portion 16*d* to the recess 16*c*, as shown in FIG. 19. Further, the rear projection 2*b* of the trigger 2 comes into contact with the lower contacting portion 20*b* of the rotatable member 20 and causes temporarily the rotatable member 20 to rotate in the direction against the elastic force of the spring acting on the rotatable member 20 so that the upper contacting portion 20*a* of the rotatable member 20 is temporarily removed from the hammer 4.

With the upper contacting portion 20*a* of the rotatable member 20 removed from the hammer 4, the trigger 2 returns to the initial position as shown in FIGS. 1 and 2 and thereby the sliding member 13 comes into contact with the lower end portion of the hammer 4, the ascending and descending member 41 takes the lower position, the front projection 2*a* of the trigger 2 engages with the recess 16*c* of the positioning member 16 which keeps the cylindrical movable member 11 in the locked condition wherein the bullet holding chamber 31B is positioned to face closely the rear end portion of the barrel 1, and the rear projection 2*b* of the trigger 2 comes into contact with both of the projection 4*c* of the hammer 4 and the lower contacting portion 20*b* of the rotatable member 20 having the upper contacting portion 20*a* being in contact with the hammer 4. After that, when the trigger 2 is manually pulled again, the aforementioned operations are repeated so that the cylindrical movable member 11 is revolved on the central axis thereof in the "b" direction and the sham bullet BB put in the bullet holding chamber 31 newly positioned to face closely the rear end portion of the barrel 1 by the revolution of the cylindrical movable member 11 is shot through the barrel 1 by the gas pressure from the pressure accumulating chamber 30.

Although, in the first embodiment described above, the revolution of the cylindrical movable member 11 on the central axis thereof and the rotation of the hammer 4 from the initial position thereof are started in response to the manual operation to the trigger 2 and then the sham bullet put in one of the bullet holding chambers provided in the cylindrical movable member 11 is shot, it is also possible for the model gun in the type of revolver according to the present invention to make such an arrangement that the hammer 4 is first operated manually and then the trigger 2 is operated manually also so that the sham bullet BB put in one of the bullet holding chambers 31 provided in the cylindrical movable member 11 is shot.

Figure 20:
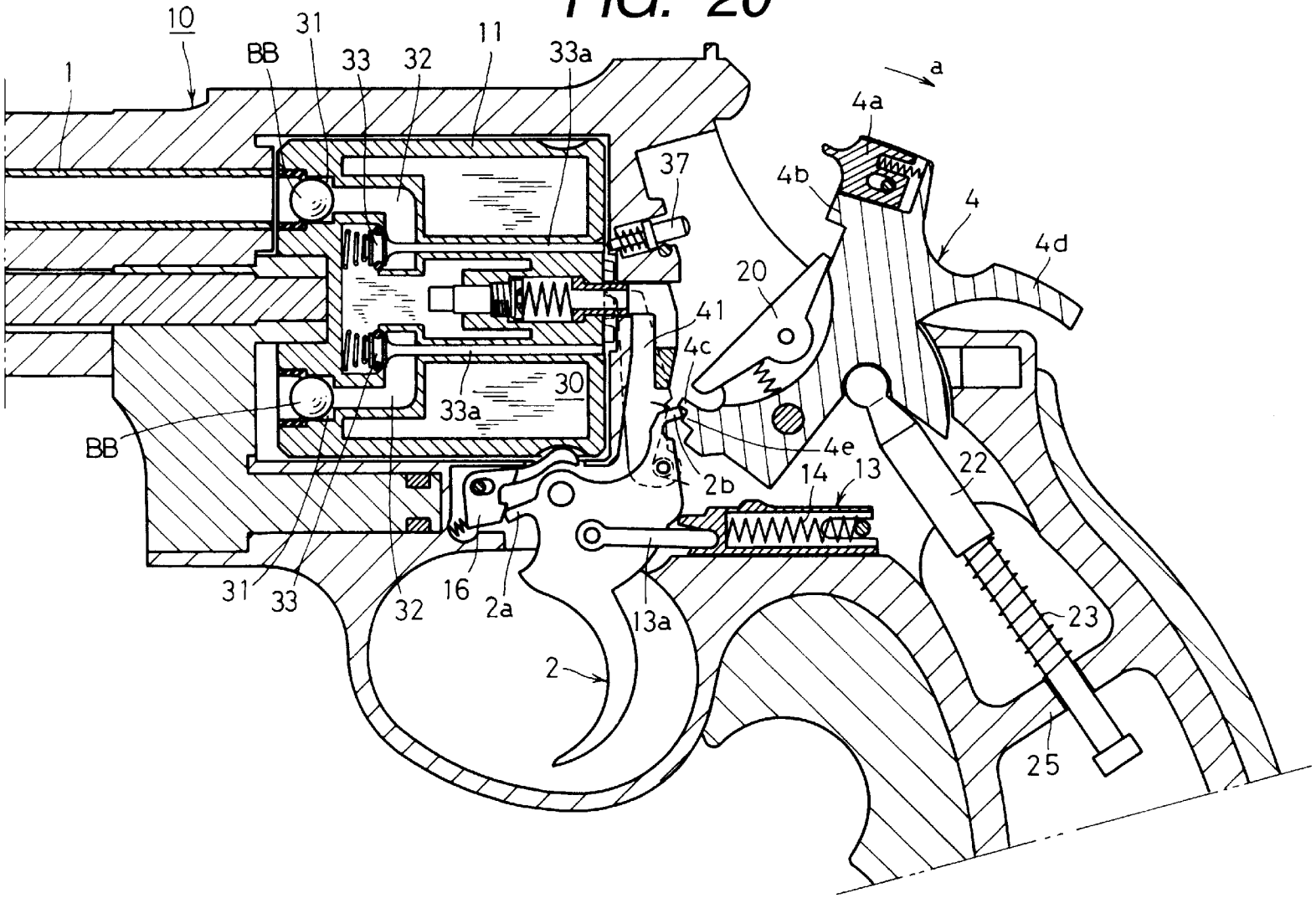

In such a case, in a situation wherein the movable mechanism keeps the cylindrical movable member 11 on the frame member 10, the control mechanism keeps the cylindrical movable member 11 in the locked. condition wherein one of the bullet holding chambers 31 provided in the cylindrical movable member 11 is positioned to face closely the rear end portion of the barrel 1, and the trigger 2 takes its initial position, the actuating portion 4*d* of the hammer 4 taking its initial position is manually operated to rotate the hammer 4 in the "a" direction to a predetermined shooting preparatory position, as shown in FIG. 20. With such rotation of the hammer 4, the hammer strut 22 is pushed down to compress the coil spring 23 mounted thereon.

The manual operation thus performed for rotating the hammer 4 to the predetermined shooting preparatory position from the initial position is transmitted to the trigger 2 which has the rear projection 2*b* being in contact with the projection 4*c* of the hammer 4, so that the trigger 2 taking its initial position is rotated in the direction against the elastic force of the spring 14 to an additional initial position. When the trigger 2 takes the additional initial position, the rear projection 2*b* of the trigger 2 engages with a cut out portion 4*e* of the hammer 4 provided for forming the projection 4*c*, as shown in FIG. 20. The additional initial position of the trigger 2 is substantially the same as the second predetermined position of the trigger 2 as shown in FIG. 15.

Accordingly, with the rotation of the trigger 2 to the additional initial position from the initial position, the positioning member 16 keeping the cylindrical movable member 11 in the locked condition is operative to release temporarily the cylindrical movable member 11 from the locked condition and then to keep again the cylindrical movable member 11 in the locked condition, and the ascending and descending member 41 is operative to ascend from its lower portion for revolving the cylindrical movable member 11 to position one of the bullet holding chambers 31 to face closely the rear end portion of the barrel 1, as shown in FIG. 3.

Figure 21:
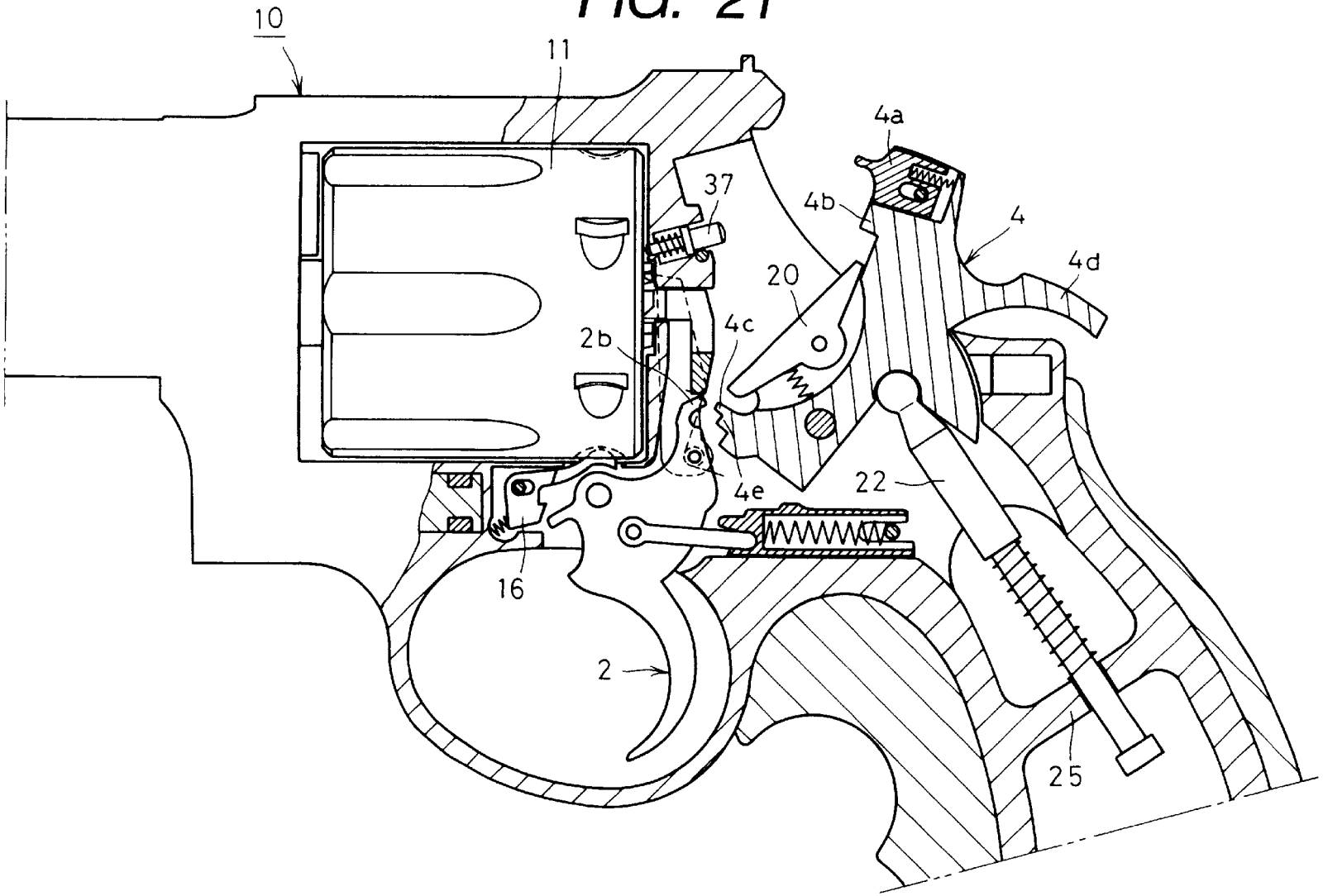

Under the condition thus prepared for causing the hammer 4 to take the shooting preparatory position and the trigger 2 to take the additional initial position, when the trigger 2 is manually pulled, the trigger 2 is rotated to the shooting position from the additional initial position and thereby the cut out portion 4*e* of the hammer 4 is released from the engagement with the rear projection 2*b* of the trigger 2 as shown in FIG. 21 and the hammer 4 is rotated in a direction reverse to the "a" direction from the shooting preparatory position. With such rotation of the hammer 4, a series of operations including the blow by the hammer 4 at the blow suffering member 37, the movement of the sham bullet BB into the barrel 1 from the bullet holding chamber 31 positioned to face closely the rear end portion of the barrel 1 caused with the gas pressure, the shooting of the sham bullet from the muzzle by way of the gas pressure, the return of the hammer 4 to the initial position and the return of the trigger 2 to the initial position from the shooting position, are performed, as shown in FIG. 17.

Figure 22:
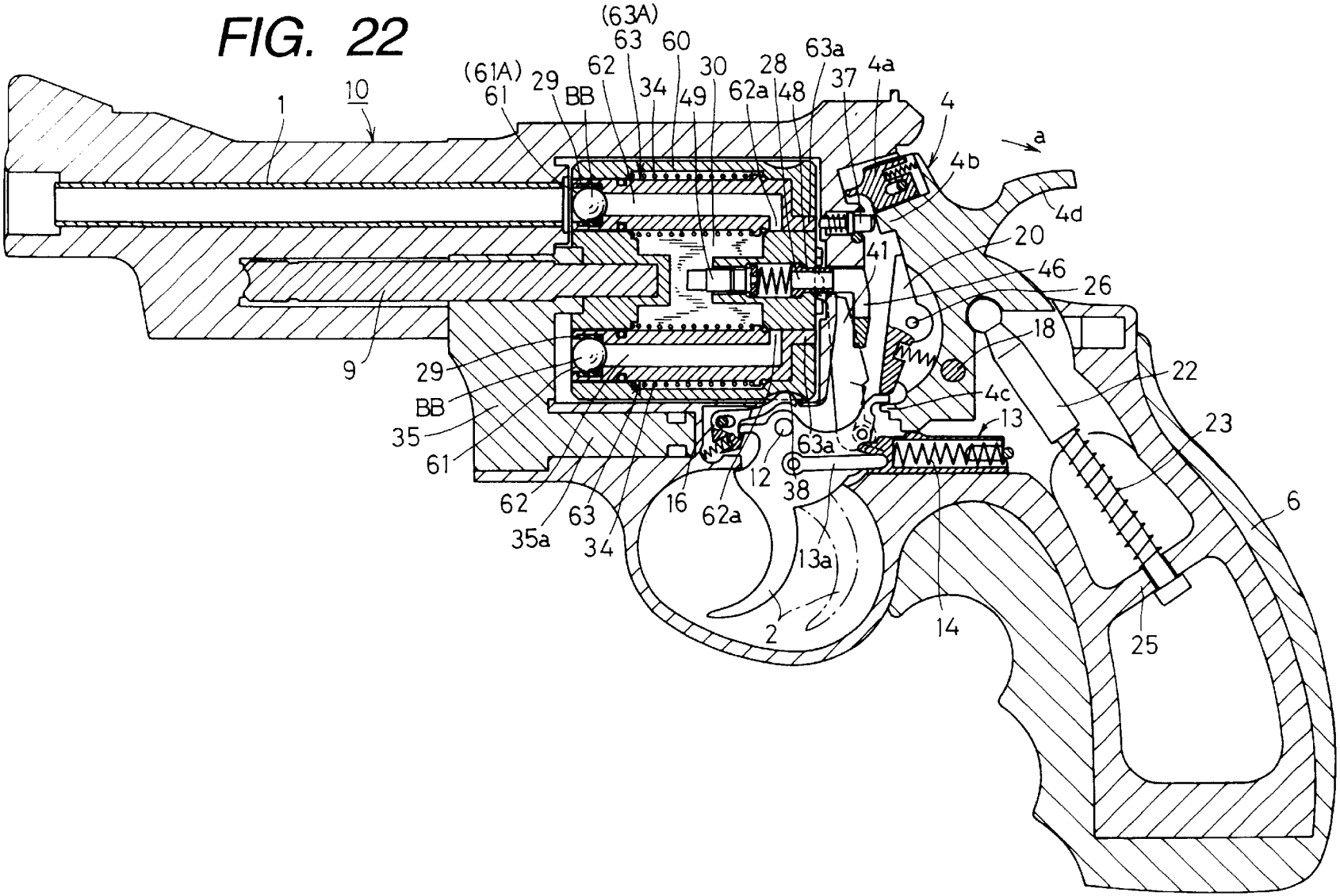
FIG. 22 is a schematic cross sectional view showing another embodiment of model gun in the type of revolver according to the present invention.
Figure 23:
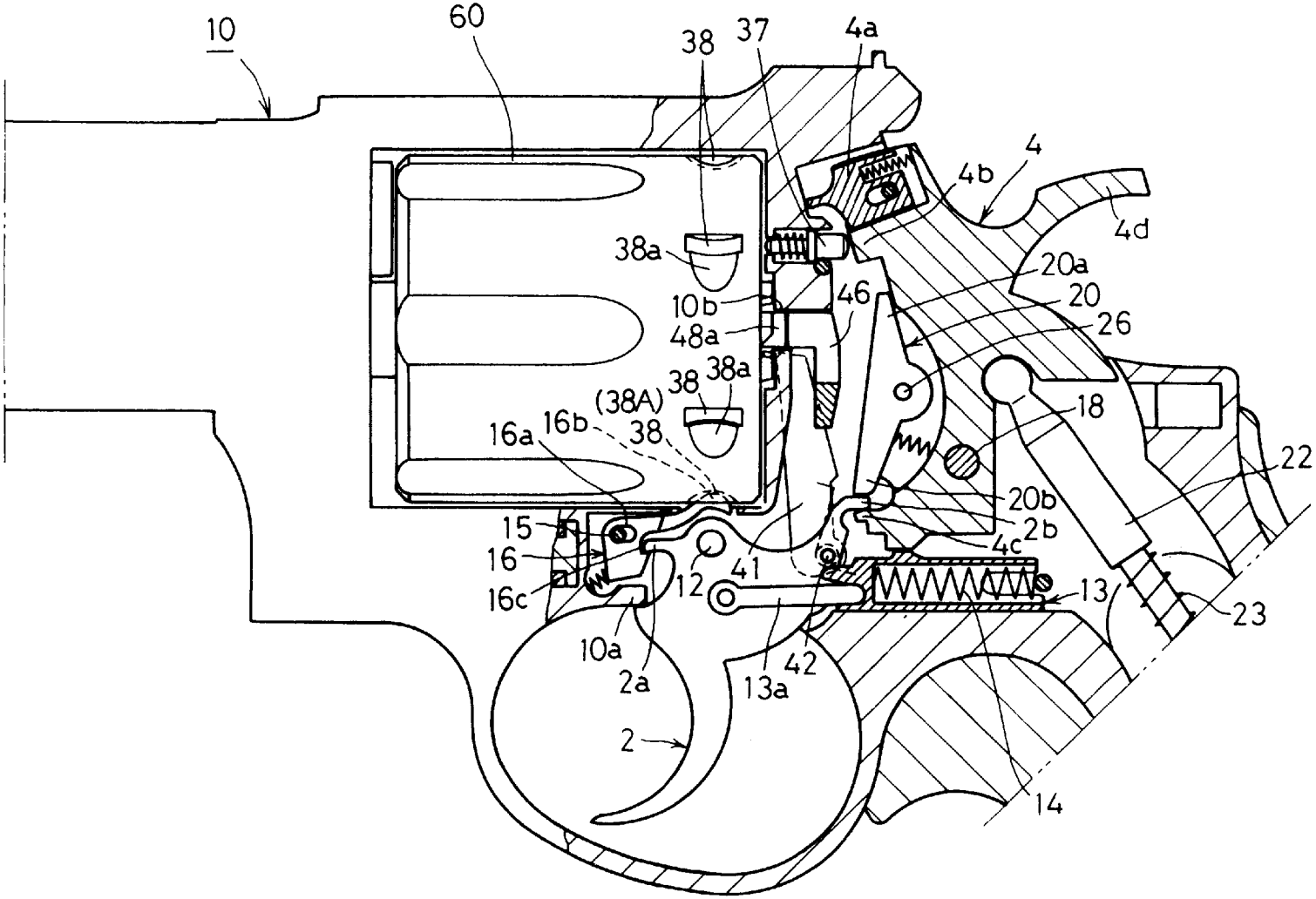
FIG. 23 is a partial side and cross sectional view used for explaining the operation of the embodiment shown in FIG. 22.

FIGS. 22 and 23 show a second embodiment of model gun in the type of revolver according to the present invention.

Referring to FIGS. 22 and 23, in the second embodiment, a cylindrical movable member 60 is employed in place of the cylindrical movable member 11 in the first embodiment shown in FIGS. 1 and 2 and various parts other than the cylindrical movable member 60 of the second embodiment are constituted in almost the same manner as those in the first embodiment.

In FIGS. 22 and 23, portions and members corresponding to those in FIGS. 1 and 2 are marked with the same references and further description thereof will be omitted. Further, although figures are omitted, the second embodiment shown in FIGS. 22 and 23 is also provided with a movable mechanism including a rotation prohibiting member and a guiding portion in the same manner as the movable mechanism including the rotation prohibiting member 45 shown in FIG. 5 and the guiding portion 53 shown in FIG. 9 and provided in the first embodiment shown in FIGS. 1 and 2.

Referring to the FIGS. 22 and 23, in the second embodiment, the cylindrical movable member 60 which is loaded with a plurality of sham bullets to be shot with gas pressure is detachably mounted with its central axis extending substantially in parallel with a central axis of a barrel 1 on a frame member 10 between the barrel 1 and a hammer 4. This cylindrical movable member 60 is able to be rotated on its central axis and detached from the frame member 10 to take a swung out position in the same manner as the cylindrical movable member 11 shown in FIGS. 1 and 2.

The cylindrical movable member 60 contains a pressure accumulating chamber 30 which is charged through a gas injecting port 28 with, for example, liquefied gas, and a plurality of movable valves 63 arranged around the central axis of the cylindrical movable member 60 at predetermined angular intervals. Each of the movable valves 63 is provided therein with a bullet holding chamber 61 in which a sham bullet BB is put to be shot with gas pressure from the pressure accumulating chamber 30 and a gas leading passage 62 extending from the bullet holding chamber 61 and contained in the pressure accumulating chamber 30.

The movable valves 63 make such an arrangement that a plurality of bullet holding chambers 61 each having its central axis extending substantially in parallel with the central axis of the barrel 1 are arranged around the central axis of the cylindrical movable member 60. Further, each of the movable valves 63 is able to move in a direction substantially in parallel with the central axis of the barrel 1 and provided with a coil spring 34 mounted thereon.

A small projection 63*a* is formed on a rear end portion of each of the movable valves 63. This small projection 63*a* is positioned out of the central axis of the bullet holding chamber 61 and formed into a short rod extending backward to pass through a hollow provided on a rear end portion of the cylindrical movable member 60 to the outside of the cylindrical movable member 60.

One of the bullet holding chambers 61 is positioned to face a rear end portion of the barrel 1 and an annular holding member 29 made of elastic material is put in each of the bullet holding chambers 61 for holding the sham bullet BB put therein. A gas introducing port 62*a* is provided on each of the movable valves 63 to be adjacent to the rear end portion thereof and connected with the gas leading passage 62 formed therein.

The movable valve 63 provided in the cylindrical movable member 60 is forced by the coil spring 34 in a direction for removing the gas introducing port 62*a* connected with the gas leading passage 62 from the pressure accumulating chamber 30 so as to control the gas leading passage 62 to be closed to the pressure accumulating chamber 30. When the movable valve 63 is moved against the elastic force of the coil spring 34 in such a manner as described later on, the bullet holding chamber 61 facing the rear end portion of the barrel 1 is moved to come into contact with the rear end portion of the barrel 1 and the gas introducing port 62*a* connected with the gas leading passage 62 is moved to open into the pressure accumulating chamber 30 so as to connect the gas leading passage 62 with the pressure accumulating chamber 30.

Each of the movable valves 63 thus provided takes a gas introducing position for introducing the gas pressure from the pressure accumulating chamber 30 through the gas introducing port 62*a* to the gas leading passage 62 when the bullet holding chamber 61 facing the rear end portion of the barrel 1 is moved to come into contact with the rear end portion of the barrel 1 and the gas introducing port 62*a* connected with the gas leading passage 62 is moved to open into the pressure accumulating chamber 30 and takes a gas shutting off position for shutting off the gas pressure from the pressure accumulating chamber 30 when the gas introducing port 62*a* connected with the gas leading passage 62 is removed from the pressure accumulating chamber 30.

The gas leading passage 62 which is formed in the movable valve 63 provided in the cylindrical movable member 60 and selectively connected through the gas introducing port 62*a* with the pressure accumulating chamber 30 so that the bullet holding chamber 61 is led through the gas leading passage 62 to the pressure accumulating chamber 30, is formed to be relatively short in its entirety.

In case of the second embodiment shown in FIGS. 22 and 23, six movable valves 63 are provided in the cylindrical movable member 60 and therefore the cylindrical movable member 60 contains substantially six bullet holding chambers 61 and six gas leading passages 62 in addition to the pressure accumulating chamber 30. (Two of the six movable valves 63, each of which is provided therein with the bullet holding chamber 61 and the gas leading passage 62, appear in FIG. 22.)

A rod 9 extends forwardly from a central portion of the cylindrical movable member 60 in which the pressure accumulating chamber 30 is provided and the movable valves 63 are arranged around the central axis of the cylindrical movable member 60. The cylindrical movable member 60 is supported in its entirety by a supporting member 35 to be able to revolve on a central axis thereof passing through the center of the rod 9 in the same manner as the cylindrical movable member 11 employed in the first embodiment shown in FIGS. 1 and 2. Accordingly, when a movable mechanism including a tubular member 48 is operative to release the cylindrical movable member 60 from the locked condition, the cylindrical movable member 60 is able to be detached from the frame member 10 to take a swung out position in the same manner as the cylindrical movable member 11 employed in the first embodiment shown in FIGS. 1 and 2. Then, with the cylindrical movable member 60 placed at the swung out position, the bullet holding chambers 61 provided in the cylindrical movable member 60 can be easily and surely loaded with the sham bullets BB and the pressure accumulating chamber 30 provided in the cylindrical movable member 60 can be easily and surely charged with liquefied gas.

Each of the movable valves 63 is successively positioned to cause the bullet holding chamber 61 to face the rear end portion of the barrel 1 in such a manner that the central axis of the bullet holding chamber 61 is substantially coincident with the central axis of the barrel 1 with the revolution of the cylindrical movable member 60 on the central axis thereof. Accordingly, when one of the movable valves 63 is positioned to cause the bullet holding chamber 61 to face the rear end portion of the barrel 1, the small projection 63*a* formed on the rear end portion of the movable valve 63 which is provided with the bullet holding chamber 61 facing the rear end portion of the barrel 1 is positioned out of the central axis of the bullet holding chamber 61 facing the rear end portion of the barrel 1 and therefore positioned out of the central axis of the barrel 1.

Further, when one of the movable valves 63 is positioned to cause the bullet holding chamber 61 to face the rear end portion of the barrel 1, an end portion of the small projection 63*a* formed on the rear end portion of the movable valve 63 which is provided with the bullet holding chamber 61 facing the rear end portion of the barrel 1 is positioned to be adjacent to a front end portion of a blow suffering member 37 for suffering blow by the hammer 4 at its rear end portion. The blow suffering member 37 is forced by a spring to tend to go away from the end portion of the small projection 63*a* positioned to be adjacent to the front end portion of the blow suffering member 37. When a striking portion 4*b* of the hammer 4 strikes the blow at the rear end portion of the blow suffering member 37, the blow suffering member 37 is operative to transmit surely the blow by the hammer 4 through the end portion of the small projection 63*a* to the movable valve 63.

Figure 24:
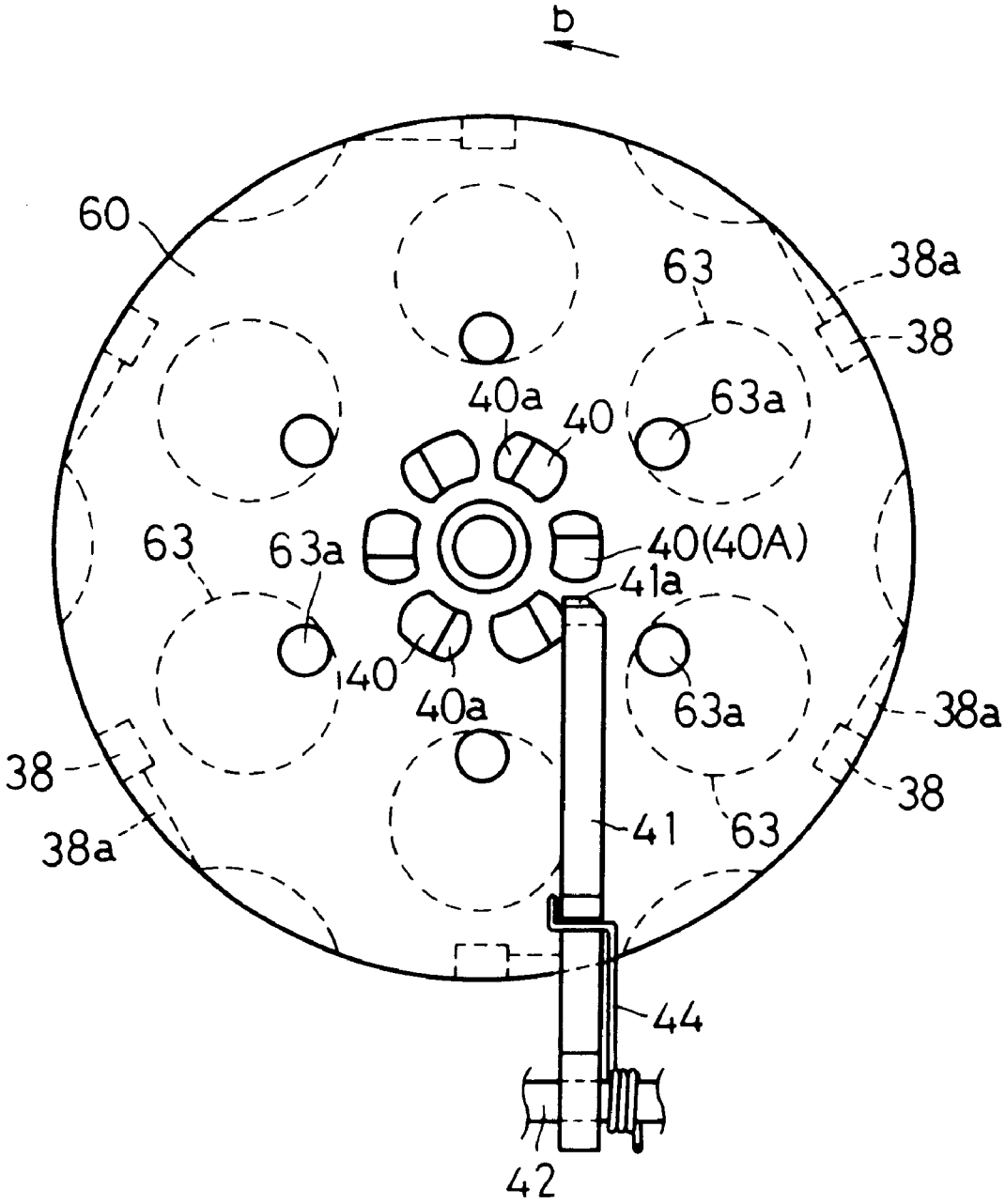
FIG. 24 is a rear view used for explaining the operation of the embodiment shown in FIG. 22.

The cylindrical movable member 60 is revolved on the central axis thereof in the "b" direction by the ascent of an ascending and descending member 41 provided in relation to a plurality of projections 40 formed on a rear end surface of the cylindrical movable member 60, as shown in FIG. 24. The number of the projections 40 is the same as that of the bullet holding chambers 61, for example, six.

The revolution of the cylindrical movable member 60 on the central axis thereof is carried out at every predetermined revolving angle to cause successively each of the bullet holding chambers 61 provided in the movable valves 63, respectively, to face the rear end portion of the barrel 1.

In the second embodiment employing the cylindrical movable member 60 as described above, when the sham bullet BB put in one of the bullet holding chambers 61 provided in the cylindrical movable member 60 is shot, a trigger 2 taking its initial position, as indicated with a solid line in FIG. 22, is manually pulled under a condition wherein the movable mechanism keeps the cylindrical movable member 60 on the frame member 10, a control mechanism keeps the cylindrical movable member 60 in the locked condition wherein one of the bullet holding chambers 61, for example, a bullet holding chambers 61A as shown in FIG. 22 is positioned to face the rear end portion of the barrel 1, and the hammer 4 takes its initial position.

In such a condition, each of the movable valves 63 including the movable valve 63A and provided in the cylindrical movable member 60 is caused to take the gas shutting off position for removing the gas introducing port 62*a* connected with the gas leading passage 62 from the pressure accumulating chamber 30 and the end portion of the small projection 63*a* formed on the movable valves 63A is positioned to be adjacent to the front end of the front end portion of the blow suffering member 37.

When the trigger 2 taking its initial position is manually pulled and the trigger 2 is rotated from the initial position to a shooting position as indicated with a dot-dash line in FIG. 22, the hammer 4 is rotated in the "a" direction from the initial position and a hammer strut 22, a positioning member 16, the ascending and descending member 41 and so on operate in the same manner as those in the first embodiment. Further, the cylindrical movable member 60 is revolved on the central axis thereof in the "b" direction so as to position a bullet holding chamber 61B provided in a movable valve 63B (shown in FIG. 25) next to the movable valve 63A to face the rear end portion of the barrel 1.

Figure 25:
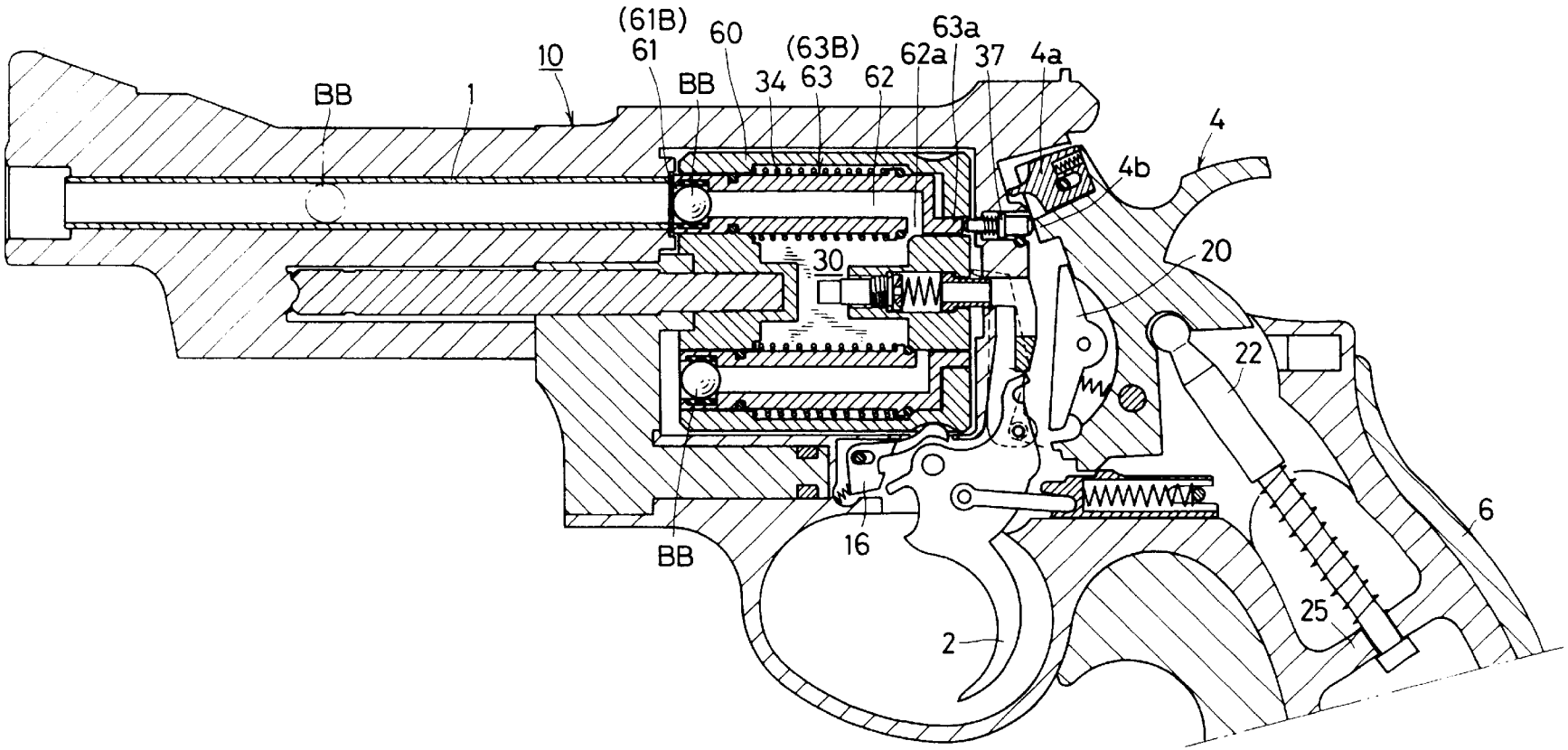
FIGS. 25 and 26 are partial cross sectional views used for explaining the operation of the embodiment shown in FIG. 22.

Then, once the trigger 2 has just reached the shooting position as shown in FIG. 25, the hammer 4 is rotated in the direction reverse to the "a" direction by way of inertia and a striking portion 4*b* of the hammer 4 strikes a blow at the rear end portion of the blow suffering member 37 to move the blow suffering member 37 in a direction against the elastic force of a spring acting on the blow suffering member 37.

With such movement of the blow suffering member 37, the blow by the hammer 4 is transmitted through the blow suffering member 37 to the small projection 63*a* formed on the rear end portion of the movable valve 63B. Accordingly, the small projection 63*a* specifies substantially a portion for suffering the blow by the hammer 4.

The small projection 63*a* formed on the rear end portion of the movable valve 63B is positioned out of the central axis of the bullet holding chamber 61B provided in the movable valve 63B to face the rear end portion of the barrel 1 and therefore positioned out of the central axis of the barrel 1.

The movable valve 63B having the small projection 63*a* to which the blow by the hammer 4 is transmitted through the blow suffering member 37 is moved in the direction against the elastic force of the coil spring 34 acting on the movable valve 63B to cause the bullet holding chamber 61B to come into contact with the rear end portion of the barrel 1 and takes the gas introducing position for connecting the gas leading passage 62 through the gas introducing port 62*a* with the pressure accumulating chamber 30. As a result, the gas pressure is supplied to the bullet holding chamber 61B through the gas leading passage 62 connected with the gas introducing port 62*a* from the pressure accumulating chamber 30 to act on the sham bullet BB put in the bullet holding chamber 61B. Since the gas leading passage 62 which leads the gas pressure from the pressure accumulating chamber 30 to the bullet holding chamber 61B is formed to be relatively short in its entirety, the gas pressure supplied to the bullet holding chamber 61B from the pressure accumulating chamber 30 acts on the sham bullet BB put in the bullet holding chamber 61B with enough pressure value.

The sham bullet BB put in the bullet holding chamber 61B is forcibly moved into the barrel 1 from the bullet holding chamber 61B with the gas pressure having enough pressure value, as indicated with a dot-dash line in FIG. 25. Then, the sham bullet BB is accelerated to move forward in the barrel 1 by the gas pressure flowing into the barrel through the bullet holding chamber 61B and the gas leading passage 62 from the pressure accumulating chamber 30 and shot from a muzzle at a front end portion of the barrel 1.

Figure 26:
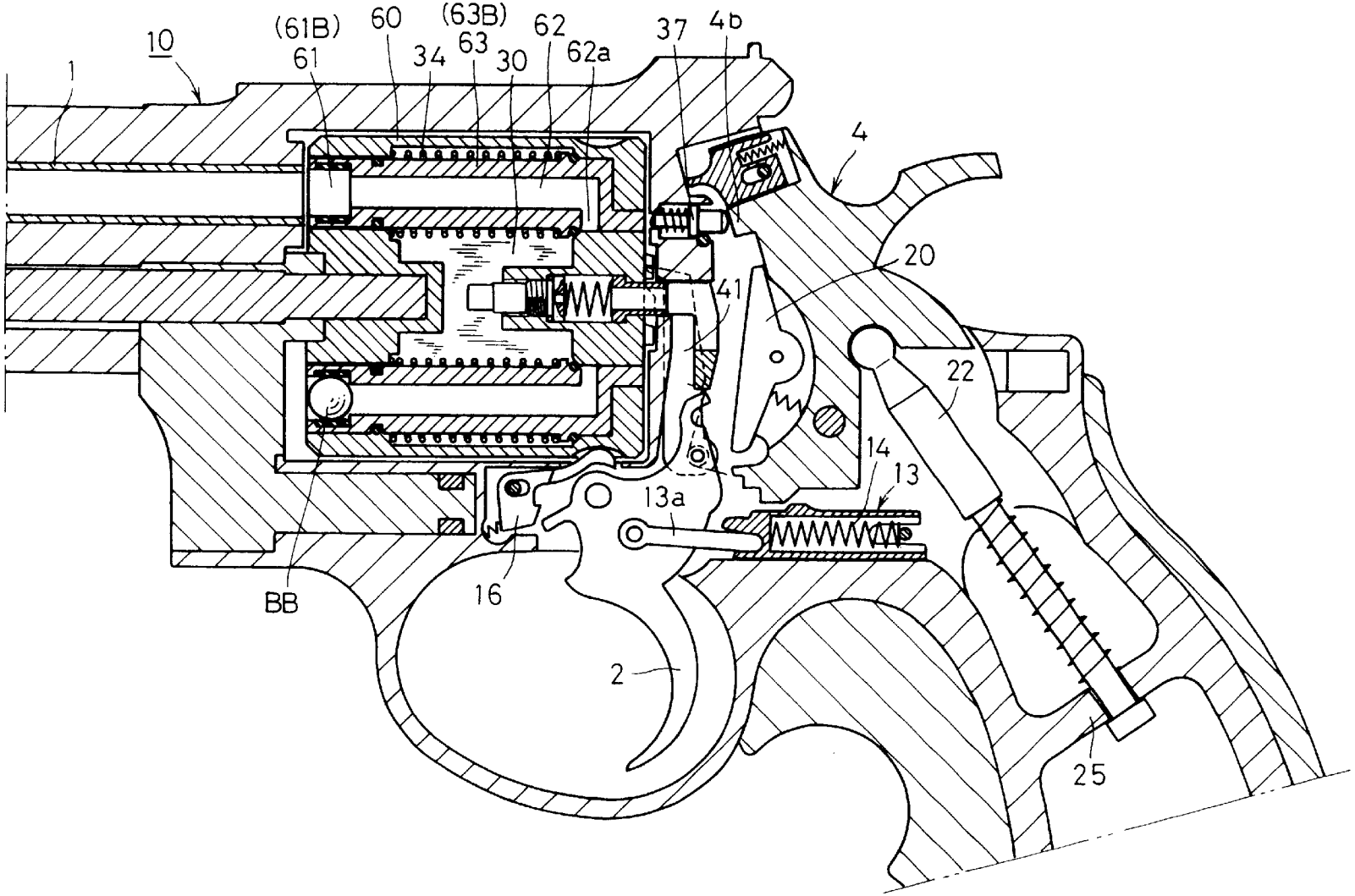

Simultaneously with the shot of the sham bullet BB from the muzzle, the hammer 4 returns to the initial position, the blow suffering member 37 moves in the direction according to the elastic force of the spring acting on the blow suffering member 37 and the movable valve 63B moves also in the direction according to the elastic force of the coil spring 34 acting on the movable valve 63B. As a result, the bullet holding chamber 61B is removed from the rear end portion of the barrel 1 to be positioned to face the rear end portion of the barrel 1 and the movable valve 63B takes the gas shutting off position for removing the gas introducing port 62*a* connected with the gas leading passage 62 from the pressure accumulating chamber 30, so that the gas pressure is ceased to be supplied to the bullet holding chamber 61B through the gas leading passage 62 from the pressure accumulating chamber 30, as shown in FIG. 26.

After the trigger 2 has reached the shooting position for shooting the sham bullet BB through the barrel 1, the trigger 2 is rotated to return to the initial position in the same manner as that in the first embodiment shown in FIGS. 1 and 2. Further, the ascending and descending member 41, the positioning member 16 and so on operate also in the same manner as those in the first embodiment shown in FIGS. 1 and 2. Then, when the trigger 2 taking its initial position as shown in FIG. 22 is manually pulled again, the sham bullet BB is shot through the barrel 1, as described above.

In the second embodiment shown in FIGS. 22 and 23 and described above, it is also possible to make such an arrangement that the hammer 4 is first operated manually and then the trigger 2 is operated manually also so that the sham bullet BB put in one of the bullet holding chambers 61 provided in the cylindrical movable member 60 is shot in the same manner as the first embodiment shown in FIGS. 1 and 2.

In such a case, under a situation wherein the movable mechanism keeps the cylindrical movable member 60 on the frame member 10, the control mechanism keeps the cylindrical movable member 60 in the locked condition wherein one of the bullet holding chambers 61 provided in the cylindrical movable member 60 is positioned to face the rear end portion of the barrel 1, and the trigger 2 takes its initial position, as shown in FIGS. 22 and 23, the actuating portion 4*d* of the hammer 4 taking its initial position is manually operated to rotate the hammer 4 in the "a" direction to a predetermined shooting preparatory position in the same manner as the first embodiment shown in FIGS. 1 and 2 and then the trigger 2 taking its initial position is manually pulled.

What is claimed is:

1. A model gun in the type of revolver comprising:

a frame member to which a barrel and a hammer is rotatably attached, a cylindrical movable member containing a pressure accumulating chamber for accumulating gas pressure, a plurality of bullet holding chambers arranged around a central axis of said cylindrical movable member at predetermined angular intervals for holding sham bullets respectively, a plurality of gas leading passages connected with the bullet holding chambers respectively, and a plurality of valves each operative to cause one of the gas leading passages to open into the pressure accumulating chamber in response to movement of the hammer and mounted detachably on the frame member between the barrel and the hammer, a control mechanism operative to keep selectively the cylindrical movable member mounted detachably on the frame member in a locked condition wherein one of the bullet holding chambers is positioned to face closely a rear end portion of the barrel and to release the cylindrical movable member mounted detachably on the frame member from the locked condition so as to be revolved on a central axis thereof in response to positions of a trigger, a driving mechanism operative to cause the cylindrical movable member mounted detachably on the frame member and released from the locked condition to revolve on the central axis thereof in accordance with movement of the trigger, and a supporting member attached rotatably to the frame member for supporting the cylindrical movable member so as to be mounted detachably on the frame member and detached from the frame member to take a swung out position selectively.

2. A model gun in the type of revolver according to claim 1, wherein the cylindrical movable member commences to be revolved on the central axis thereof by the driving mechanism and the hammer commences to rotate from its initial position when the trigger is pulled in a situation wherein the cylindrical movable member supported by the supporting member is mounted detachably on the frame member, and after the cylindrical movable member stops revolving, the hammer rotates to strike a blow at a portion for suffering the blow by the hammer and returns to its initial position and one of the valves, which corresponds to the gas leading passage connected with the bullet holding chamber facing closely the rear end portion of the barrel, operates with the blow by the hammer to cause the corresponding gas leading passage to open into the pressure accumulating chamber.

3. A model gun in the type of revolver according to claim 2, wherein the portion for suffering the blow by the hammer is positioned out of a central axis of the bullet holding chamber facing closely the rear end portion of the barrel.

4. A model gun in the type of revolver according to claim 1, wherein the pressure accumulating chamber, the bullet holding chambers and the gas leading passages are formed to be fixed in the cylindrical movable member and the valves are constituted of a plurality of opening and closing valves provided to correspond to the gas leading passages, respectively.

5. A model gun in the type of revolver according to claim 4, wherein a blow by the hammer at a portion for suffering the blow by the hammer is transmitted to one of the opening and closing valves in the cylindrical movable member mounted detachably on the frame member.

6. A model gun in the type of revolver according to claim 1, wherein the pressure accumulating chamber is formed to be fixed in the cylindrical movable member and the valves are constituted of a plurality of movable valves each containing the bullet holding chamber and the gas leading passage connected with the bullet holding chamber and operative to take selectively a gas shutting off position for removing the gas leading passage from the pressure accumulating chamber and a gas introducing position for causing the gas leading passage to open into the pressure accumulating chamber.

7. A model gun in the type of revolver according to claim 6, wherein a blow by the hammer at a portion for suffering the blow by the hammer is transmitted to one of the movable valves in the cylindrical movable member mounted detachably on the frame member.

8. A model gun in the type of revolver according to claim 1, wherein a movable mechanism is provided to be operative selectively to keep the cylindrical movable member on the frame member and to allow the cylindrical movable member to be removed from the frame member to the swung out position and said movable mechanism includes a member provided in the cylindrical movable member for constituting a gas injecting port to the pressure accumulating chamber.

9. A model gun in the type of revolver according to claim 8, wherein the member constituting the gas injecting port is operative to cause an end portion thereof to project from the cylindrical movable member to the outside of the same when the cylindrical movable member is mounted detachably on the frame member and otherwise placed at the swung out position and to cause the end portion thereof to come into the cylindrical movable member when the cylindrical movable member is detached from the frame member to take the swung out position and otherwise moved from the swung out position to be mounted detachably on the frame member.

* * * * *